US010538086B2

(12) United States Patent
Fujii et al.

(10) Patent No.: US 10,538,086 B2
(45) Date of Patent: Jan. 21, 2020

(54) LIQUID DISCHARGE HEAD SUBSTRATE, LIQUID DISCHARGE HEAD AND LIQUID DISCHARGE APPARATUS

(71) Applicant: CANON KABUSHIKI KAISHA, Tokyo (JP)

(72) Inventors: Yasuo Fujii, Hiratsuka (JP); Kazunari Fujii, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/617,276

(22) Filed: Jun. 8, 2017

(65) Prior Publication Data

US 2017/0368821 A1 Dec. 28, 2017

(30) Foreign Application Priority Data

Jun. 23, 2016 (JP) ..... 2016-124799
May 24, 2017 (JP) ..... 2017-102959

(51) Int. Cl.
*B41J 2/14* (2006.01)
*B41J 2/05* (2006.01)
*B41J 2/045* (2006.01)

(52) U.S. Cl.
CPC ..... *B41J 2/14072* (2013.01); *B41J 2/0458* (2013.01); *B41J 2/04501* (2013.01); *B41J 2/04531* (2013.01); *B41J 2/04541* (2013.01); *B41J 2/05* (2013.01); *B41J 2/14088* (2013.01); *B41J 2/14112* (2013.01); *B41J 2/14129* (2013.01)

(58) Field of Classification Search
CPC .. B41J 2/14072; B41J 2/0458; B41J 2/04531; B41J 2/04541; B41J 2/04501; B41J 2/05; B41J 2/14088; B41J 2/14112; B41J 2/14129
See application file for complete search history.

(56) References Cited

U.S. PATENT DOCUMENTS 9,555,653 B2 * 1/2017 Kanno ..... B41J 29/393
2007/0146428 A1 * 6/2007 Sakai ..... B41J 2/14072 347/50
2014/0368581 A1 12/2014 Takahashi et al.
2016/0380177 A1 * 12/2016 Ebigase ..... H01L 41/0533 310/328

FOREIGN PATENT DOCUMENTS

JP 2012-101557 A 5/2012
JP 2015-000546 A 1/2015

* cited by examiner

*Primary Examiner* — Justin Seo
(74) *Attorney, Agent, or Firm* — Venable LLP

(57) ABSTRACT

A liquid discharge head substrate, comprising a discharging element configured to discharge a liquid, a driver configured to drive the discharging element, a conductive protection film covering the discharging element via an insulating film, and a controller connected to the protection film and configured to output a control signal that sets the driver in an inactive state when a change of a voltage of the protection film or a change in a current that flows to the protection film is detected.

27 Claims, 16 Drawing Sheets

LIQUID DISCHARGE HEAD SUBSTRATE, LIQUID DISCHARGE HEAD AND LIQUID DISCHARGE APPARATUS

BACKGROUND OF THE INVENTION

Field of the Invention

The present invention relates to a liquid discharge head substrate, a liquid discharge head, and a liquid discharge apparatus.

Description of the Related Art

In Japanese Patent Laid-Open No. 2015-546, a liquid discharge head substrate comprising a discharging element for discharging a liquid and a protection film (anti-cavitation film) for protecting the discharging element from a shock due to cavitation in the liquid is disclosed. By driving a discharging element, liquid in its vicinity is discharged from a nozzle of the liquid discharge head. Conductive material such as, for example, tantalum, iridium, platinum or the like may be used for a protection film, and the protection film may be arranged to cover the discharging element via an insulating film.

There are cases in which the result of the cavitation in the liquid is that the protection film shorts with the discharging element or a part of its peripheral circuit (a signal line for driving the discharging element, power supply wiring, or the like) due to the insulating film breaking or the like, and there is the possibility that an unexpected operation defect will occur because of this.

SUMMARY OF THE INVENTION

The present invention provides a technique that is advantageous, in a case when a short of a protection film occurs, at preventing the occurrence of an operation defect that accompanies this.

One of the aspects of the present invention provides a liquid discharge head substrate, comprising a discharging element configured to discharge a liquid, a driver configured to drive the discharging element, a conductive protection film covering the discharging element via an insulating film, and a controller connected to the protection film and configured to output a control signal that sets the driver in an inactive state when a change of a voltage of the protection film or a change in a current that flows to the protection film is detected.

Further features of the present invention will become apparent from the following description of exemplary embodiments with reference to the attached drawings.

DESCRIPTION OF THE EMBODIMENTS

Figure 1:
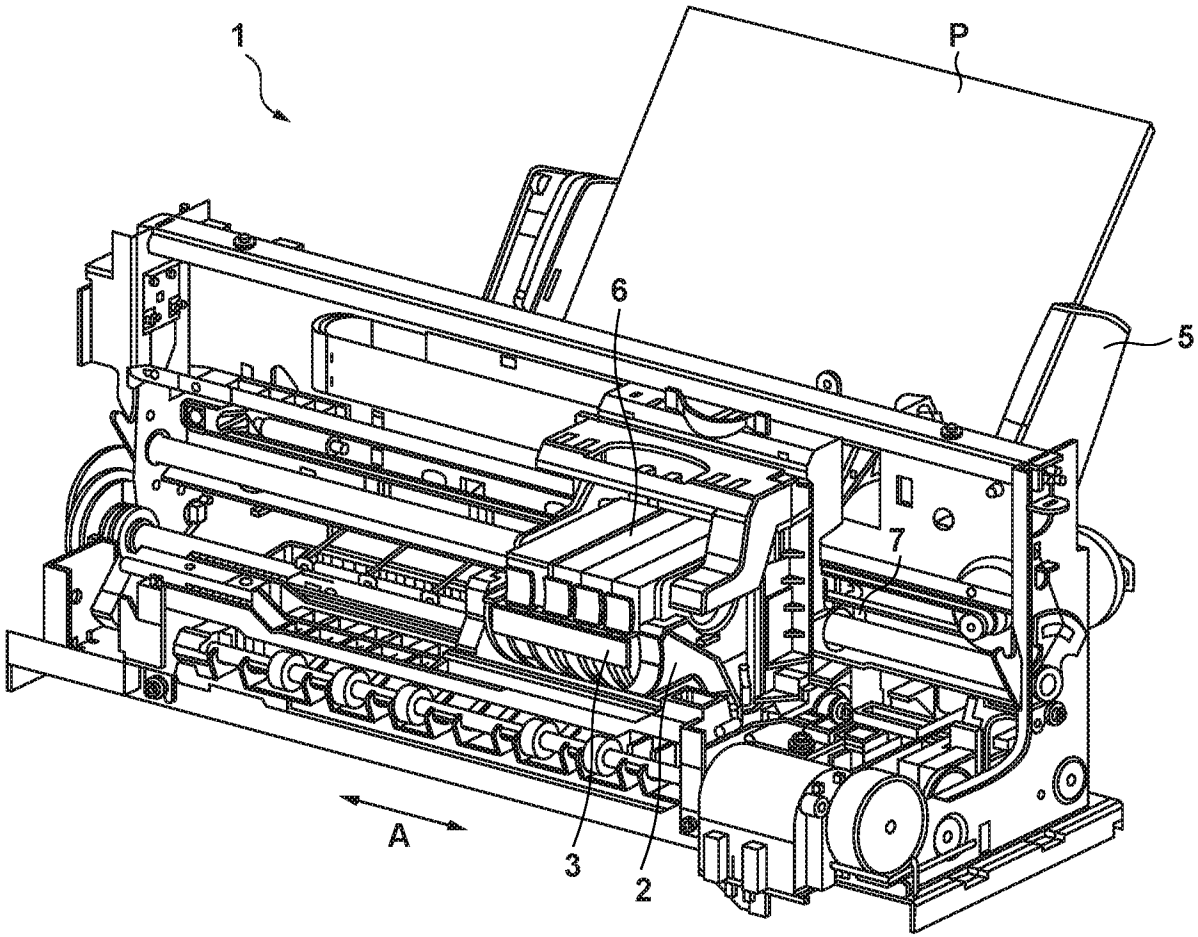
FIG. 1 is a drawing for describing an example of the configuration of the liquid discharge apparatus.

Hereinafter, description will be given regarding preferred embodiments of the present invention with reference to the attached drawings. Note that each drawing is given merely with the objective of describing structure and configuration, and the dimensions of each member shown graphically do not necessarily reflect the actual dimensions. Also, in the drawings, the same reference numerals are given to members that are the same and elements that are the same, and duplicate descriptions of content are omitted below.

In the present specification, a change of voltage applied to a member encompasses not only a voltage value changing but also cases in which a member changes from a floating state to a state having some potential. Also, changing the current that flows to a member encompasses not only the current value changing but also changing from a state in which a current is not flowing in a member to a state in which a current does flow. Also, putting (or setting) a member into an inactive state encompasses not only a case in which a member changes from an active state to an inactive state, but also cases in which an inactive state is maintained.

(Liquid Discharge Apparatus Configuration Example)

The configuration of a liquid discharge apparatus 1 is described with reference to FIG. 1. The liquid discharge apparatus 1 is, for example, an ink-jet printing method printer (also called a printing apparatus, an image forming apparatus, or the like). FIG. 1 is a perspective view illustrating an example of a configuration of the external appearance of the liquid discharge apparatus 1. The liquid discharge apparatus 1, using a carriage 2 on which a liquid discharge head 3 is mounted, causes the liquid discharge head 3 to move back and forth in a direction of arrows A, and discharges liquid (ink) from the liquid discharge head 3 onto a print medium P such as a print sheet. The print medium P is supplied via a sheet supply mechanism 5 and is conveyed to a liquid discharge position by the liquid discharge head 3.

A cartridge 6 (ink cartridge) that contains liquid for supplying the liquid discharge head 3, for example, is mounted on the carriage 2 in addition to the liquid discharge head 3. The cartridge 6 can be freely attached/detached with respect to the carriage 2. If the liquid discharge apparatus 1 is a printer that handles color printing, for example, a plurality of cartridges that respectively contain liquids of a plurality of colors (for example, magenta (M), cyan (C), yellow (Y), black (K), or the like) are mounted to the carriage 2.

The liquid discharge head 3 is equipped with a liquid discharge head substrate comprising a plurality of nozzles (liquid discharge ports) formed on a liquid discharge surface and a plurality of discharging elements (heating elements, an electrothermal transducer, or the like) corresponding to the plurality of nozzles. Each discharging element is driven based on, for example, image data (print data) included in a print job. Thermal energy occurs in the driven discharging element, air bubbles occur in the liquid in its the vicinity thereby, and as a result, a liquid is discharged from the corresponding nozzle.

Figure 2A:
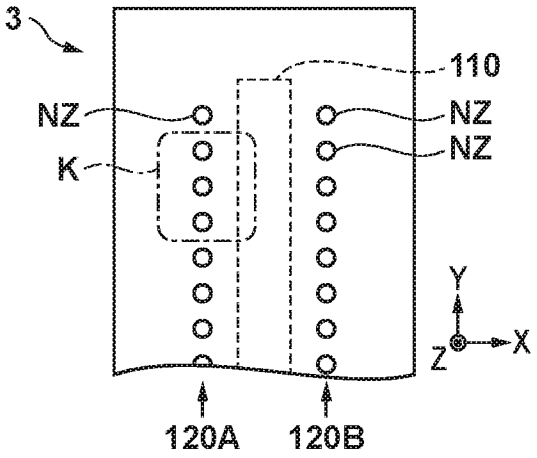
FIGS. 2A-2C are views for describing an example of a configuration of a liquid discharge head and a liquid discharge head substrate.
Figure 2B:
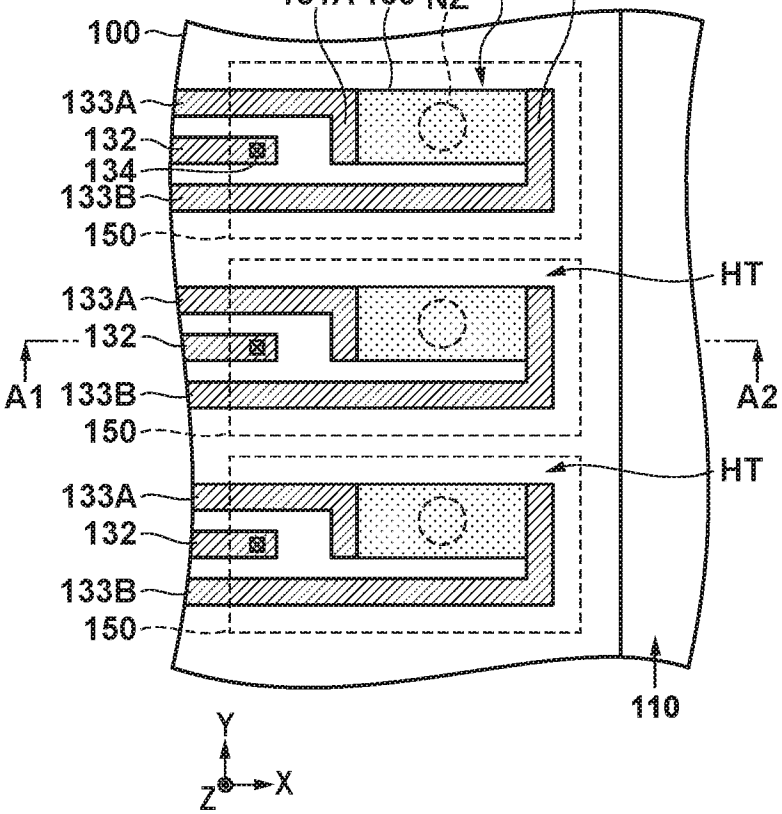
Figure 2C:
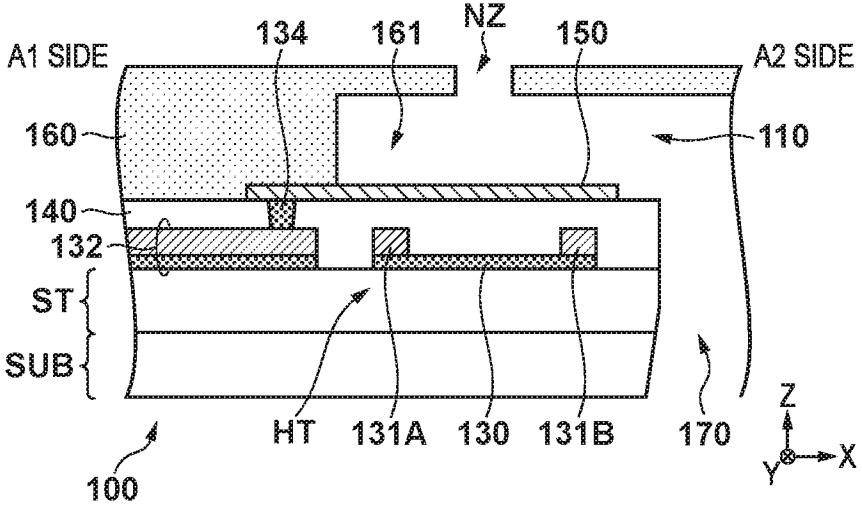

FIGS. 2A-2C are schematic diagrams for describing an example of a configuration of the liquid discharge head 3 and a liquid discharge head substrate 100. In the drawings, to facilitate comprehension of the structure, an X direction, a Y direction, and a Z direction that are mutually intersecting are illustrated. The X direction and the Y direction are directions that are orthogonal to each other, and the Z direction is an direction that is orthogonal to the plane (horizontal plane) formed by the X direction and the Y direction.

FIG. 2A is a layout view for a liquid discharge surface of the liquid discharge head 3. The liquid discharge head 3 has a liquid supply channel 110 formed in the Y direction, and two the nozzle arrays 120A 120B disposed on both sides of the liquid supply channel 110. The nozzle arrays 120A and 120B each include a plurality of nozzles NZ arranged in the Y direction. FIG. 2B is a layout view of the liquid discharge head substrate 100 corresponding to a region K in FIG. 2A. In the drawing, the nozzles NZ are illustrated together with the liquid discharge head substrate 100 in order to simplify comprehension. FIG. 2C illustrates a cross-sectional structure at a cut line A1-A2 in FIG. 2B.

The liquid discharge head substrate 100 comprises a discharging element HT. A discharging element HT is arranged above a semiconductor board SUB, and more specifically above a wiring structure ST arranged on the semiconductor board SUB. The discharging element HT includes, for example, a metal film 130, an electrode 131A arranged above one end of the metal film 130, and an electrode 131B arranged above the other end of the metal film 130. Also, the liquid discharge head substrate 100 comprises a later described driver (not shown) for driving the discharging element HT, and the driver is formed on the semiconductor board SUB.

The wiring structure ST is a structure including, for example, an insulating member and a wiring portion contained therein, and though the detailed description is omitted, for example, the wiring structure ST may be a multilayer wiring structure formed by stacking a plurality of wiring layers and a plurality of insulating layers. In FIG. 2C, the wiring layer and the insulating layer included in the wiring structure ST are not distinguished from each other and are illustrated as a single body.

Also, the liquid discharge head substrate 100 further comprises a wiring pattern 132, and the wiring pattern 132 is arranged at a position displaced in the X direction from the discharging element HT on the wiring structure ST. That is, the discharging element HT and the wiring pattern 132 align in the X direction when viewing along the line of sight in the Z direction. The wiring pattern 132 extends in the X direction, and may connect to a later described monitor unit (not shown). The wiring pattern 132 is arranged between a wiring pattern 133A that is connected to the electrode 131A and extends in the X direction and a wiring pattern 133B that is connected to the electrode 131B and extends in the X direction, and is arranged parallel to these.

An insulating film 140 is arranged so as to cover the wiring structure ST, and also the discharging element HT, and the wiring patterns 132, 133A, and 133B.

The liquid discharge head substrate 100 further comprises a conductive protection film 150. The protection film 150 is arranged so as to cover the discharging element HT via the insulating film 140 on the upper side of the discharging element HT. The protection film 150 is a film (anti-cavitation film) for protecting the discharging element HT from a shock due to cavitation at a time of liquid discharge. The protection film 150 may be configured by a conductive material such as tantalum, iridium, platinum, or the like, for example. The protection film 150 is arranged to overlap with the discharging element HT (the metal film 130 and the electrodes 131A and 131B) and to overlap with a part of the wiring pattern 132 in an orthogonal projection in a plan view in relation to the top surface of a semiconductor board SUB (in other words, a projection in a direction parallel to the Z direction. Hereinafter referred to simply as "plan view" in the present specification.). In FIG. 2B, the shape in the plan view of the protection film 150 is illustrated by a dashed line. The wiring pattern 132 is connected to the protection film 150 via a contact plug 134. The contact plug 134 is formed in a contact hole that is disposed in the insulating film 140. By this, the protection film 150 is connected to a later described monitor unit via the wiring pattern 132.

The liquid discharge head substrate 100 further comprises a liquid supplying member 160 on which the liquid supply channel 110 and a liquid channel 161 linked thereto are disposed, and the liquid supplying member 160 is arranged on the insulating film 140 and the protection film 150. An aperture 170 disposed in the semiconductor board SUB, the wiring structure ST, and the insulating film 140 penetrates through from the bottom surface of the semiconductor board SUB to the top surface of the insulating film 140, and joins the liquid supply channel 110 and the liquid channel 161. Liquid is filled into the liquid supply channel 110 and the liquid channel 161 via the aperture 170. The liquid channel 161 and the contact plug 134 do not overlap in the plan view. By arranging the contact plug 134, which breaks easily, at a position separated from a location where a cavitation occurs, it is possible to improve reliability of the substrate 100. Also, in the liquid supplying member 160, an aperture is disposed above the discharging element HT, and the aperture corresponds to the nozzle NZ.

The configurations of the liquid discharge apparatus 1 and the liquid discharge head substrate 100 described above are common with respect to the later described embodiments.

First Embodiment

Figure 3:
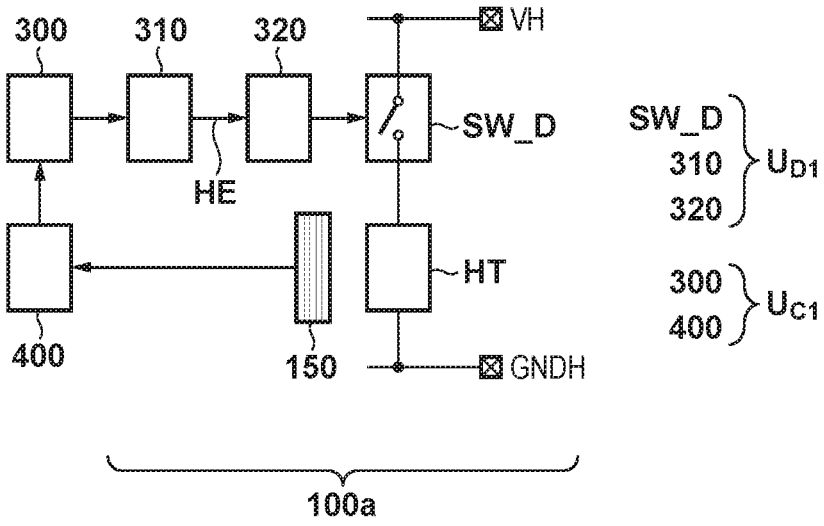
FIG. 3 is a block diagram for describing an example of a configuration of a liquid discharge head substrate.

FIG. 3 is a block diagram for describing a liquid discharge head substrate 100*a* according to the first embodiment. The substrate 100*a* comprises the discharging element HT, the protection film 150, and a driver $U_{D1}$. The driver $U_{D1}$ comprises a driving switch SW_D, a logic circuit 310, and a level converter 320. For example, in FIG. 3, the discharging element HT, the protection film 150, the driving switch SW_D, the logic circuit 310, and the level converter 320 are disposed on the same substrate. The discharging element HT and the driving switch SW_D are connected in series between power supply wiring that transmits a power source voltage VH (24 to 32[V]) and power supply wiring that transmits a voltage GNDH (0[V]) for ground. Note that to simplify the description there are cases in which the power supply wiring that transmits the voltage VH is expressed as the power supply wiring VH and the power supply wiring that transmits the voltage GNDH is expressed as the power supply wiring GNDH below.

A controller $U_{C1}$ is connected to the substrate 100*a*, and the controller $U_{C1}$ comprises a discharge controller 300 which is for controlling the discharge operation for discharging liquid and a detector 400 for detecting that a short has occurred in the protection film 150. A part of the controller $U_{C1}$ may be arranged in the substrate 100*a*. The discharge controller 300 generates a signal for controlling the driving switch SW_D in accordance with an image signal (a signal that configures image data) from an external unit in a discharging mode for performing a discharge operation. The detector 400, in a detection mode for inspecting as to whether or not the substrate 100*a* can operate appropriately prior to starting operation in the discharging mode, detects a change in the voltage of the protection film 150 or a change in the current flowing to the protection film 150. By this configuration, in a case when a change in the voltage of the protection film 150 or a change in the current that flows to the protection film 150 is detected in the detection mode, the controller $U_{C1}$, in the discharging mode, regardless of the image signal, outputs a control signal that puts (or sets) the driver $U_{D1}$ corresponding to the protection film 150 in an inactive state. When the driver $U_{D1}$ has entered the inactive state, when in the discharging mode, regardless of the image signal (specifically, even if a signal indicating a discharge of liquid is inputted), the operation is suppressed.

The logic circuit 310 receives data from the discharge controller 300, and generates a signal for controlling the driving switch SW_D, in other words, a driving signal for driving the discharging element HT, as a heat enable signal HE. The level of the signal HE is converted by the level converter 320 to a desired signal level (for example, is converted from a signal level of 3.3[V] to a signal level of 12[V]), and it is supplied to a control terminal of the driving switch SW_D. The driving switch SW_D drives the discharging element HT by entering a conductive state (in other words, by energizing the discharging element HT) in response to the level-converted signal HE. A high-voltage tolerant transistor such as a DMOS transistor, for example, can be used for the driving switch SW_D.

The discharge controller 300 can be mounted on the main body of the liquid discharge apparatus 1, and is a system controller for controlling operation of the apparatus as a whole in a discharging mode for performing a liquid discharge operation using the liquid discharge head 3. In a relationship with the liquid discharge head 3, the discharge controller 300 receives a print job from an external unit, processes the image data included therein, generates drive data for driving the liquid discharge head 3, and outputs it to the logic circuit 310. In the present embodiment, an ASIC (Application Specific Integrated Circuit) may be used for the discharge controller 300, but limitation is not made to this. For example, in other examples, an integrated circuit or a device (a PLD (Programmable Logic Device) such as an FPGA (Field Programmable Gate Array)) by which it is possible to program each function may also be used. Alternatively, each function may be realized in software by a personal computer or the like on which a predetermined program is stored.

The protection film 150 is connected to the detector 400 via the wiring pattern 132 described with reference to FIGS. 2B-2C. The detector 400 detects a change in the voltage of the protection film 150 or a change in the current flowing to the protection film 150 (hereinafter there are cases in which these are referred to collectively as the electrical signal from the protection film 150 in the present specification), and the result is outputted to the discharge controller 300.

The protection film 150, as described previously, is arranged on the discharging element HT via the insulating film 140, and is substantially insulated from the discharging element HT and other electric elements (hereinafter referred to as "the discharging element HT"). However, as there is the possibility that the insulating film 140 will break as the result of a shock due to a cavitation in the liquid. In such a state, there are cases in which, when an operation in the discharging mode is started or continued, not only is the discharging element HT not driven appropriately, but also unexpected operation failures, such as the protection film 150 dissolving in the liquid as the result of the protection film 150 to which a voltage is applied acting as a positive electrode, occur. Accordingly, if the protection film 150 electrically shorts with the discharging element HT or the like, the detector 400 detects this based on the electrical signal from the protection film 150, and notifies the discharge controller 300. By this, the controller $U_{C1}$ can determine that a short of the protection film 150 occurred.

Note that "short" here encompasses not only cases in which the protection film 150 and the discharging element HT directly contact each other, but also cases in which unintended electrical interference occurs between them. Accordingly, it is not necessarily the case that the protection film 150 is connected to the discharging element HT at 0[Ω] or relatively low impedance, upon the breaking the foregoing insulating film 140. Below, there are cases in which a short of the protection film 150 with the discharging element HT or the like is expressed simply as "short".

As mentioned above, the protection film 150 is insulated from the discharging element HT or the like. For this reason, in a state in which the insulating film 140 is not broken, the only current from the protection film 150 is a leakage current that can flow between the protection film 150 and the discharging element HT or the like, in other words, it can be said that there is substantially no current from the protection film 150. In such an example, the detector 400 may determine that a short of the protection film 150 occurred in the case where the current from the protection film 150 became larger than a reference value. Also, in the case of a configuration in which a predetermined current flows to the protection film 150 in a state in which the insulating film 140 is not broken, the detector 400 may determine that a short of the protection film 150 occurred upon detecting a change in the current flowing through the protection film 150.

In other examples, since the protection film 150 is in contact with liquid of the liquid channel 161, it may be connected to a reference voltage (0[V] here) of the semiconductor board SUB via the liquid (at a relatively high impedance). Alternatively, the protection film 150 may be connected to a reference voltage via a resistance element of a comparatively high resistance value (for example, several [KΩ] or more). In such examples, the detector 400 notifies the discharge controller 300 if the voltage of the protection film 150 changes, and the voltage value of the protection film 150 is outside of an allowable range. By this, the controller $U_{C1}$ can determine that a short of the protection film 150 occurred.

Note that the detector 400 may be arranged on a substrate different from the substrate 100*a*, but the detector 400 may be arranged on the substrate 100*a*, and a configuration in which a part of the detector 400 is arranged on the substrate 100*a* may be taken. Also, to simplify the description here, the description focussed on a single discharging element HT, but in reality, the substrate 100*a* comprises a plurality of the discharging element HT.

The discharge controller 300 can output different control signals in accordance with the operation mode (discharging mode and detection mode). For example, in the discharging mode, the discharge controller 300 outputs control signals for controlling the state of the driver $U_{D1}$ (active state or inactive state) in accordance with an image signal from an external unit. Meanwhile, in the detection mode, the discharge controller 300 detects by the detector 400 a change in the current flowing through the protection film 150 or a change in the voltage applied to the protection film 150. As described previously, the discharge controller 300, in a case when the foregoing voltage or current changed, outputs a control signal to put the driver $U_{D1}$ in the inactive state regardless of the image signal (even if an instruction to drive the droplet discharging element HT is received) in the discharging mode.

To summarize, the controller $U_{C1}$ includes the discharge controller 300 and the detector 400, and the discharge controller 300 can control the substrate 100*a* based on a signal from the detector 400, and execute or stop an operation in the discharging mode. In other words, if the detector 400 detects a short of the protection film 150, in response, the discharge controller 300 generates a control signal for suppressing the operation in the discharging mode, and reflects it in the control of the substrate 100*a*. By this, it is possible to appropriately prevent the occurrence of an operation defect that causes the foregoing short. Examples according to a first embodiment are described using FIG. 4A to FIG. 4E below.

Figure 4A:
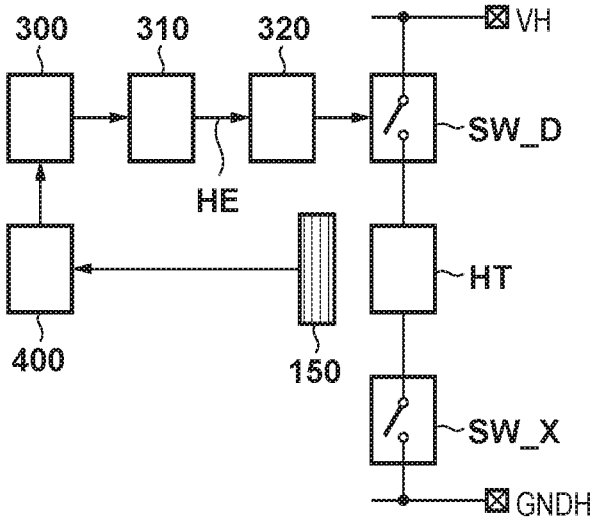
FIGS. 4A-4E are block diagrams for describing examples of configurations of the liquid discharge head substrate.

In the first example illustrated in FIG. 4A, an amperometer is used for the detector 400, and the detector 400 outputs a control signal to the discharge controller 300 based on a measurement result by the amperometer. Also, in the first example, between the power supply wiring VH and the power supply wiring GNDH, in addition to the discharging element HT and the driving switch SW_D, a control switch SW_X (hereinafter referred to simply as "control switch"), which is connected to these in series and is for switching modes, is arranged. Because the discharging element HT is not driven at the least when the control switch SW_X is not in the conductive state, it can be said the control switch SW_X configures a part of the driver $U_{D1}$.

In the discharging mode, the control switch SW_X is kept in the conductive state, and in that state, the driving switch SW_D enters the conductive state/non-conductive state based on the heat enable signal HE. In other words, if the signal HE is at an active level, the discharging element HT is energized and thereby driven, and liquid is discharged from the previously described nozzle NZ.

In an inspection mode, the control switch SW_X is kept in the non-conductive state and the driving switch SW_D is kept in the conductive state. Here, if a short of the protection film 150 does not occur, no current substantially flows between the protection film 150 and the discharging element HT, and there is substantially no current from the protection film 150. Therefore, the value of the current is smaller than the reference value, and the detector 400 outputs to the discharge controller 300 a control signal indicating that a short of the protection film 150 is not occurring. Meanwhile, if a short of the protection film 150 occurred, a current flows between the protection film 150 and the discharging element HT. So, in accordance with the value of the current becoming larger than the reference value, the detector 400 detects that the short occurred, and a control signal indicating that is outputted to the discharge controller 300.

The discharge controller 300, if it receives a control signal indicating that a short of the protection film 150 occurred from the detector 400, generates data to transmit to the logic circuit 310 so that in the discharging mode thereafter, regardless of the image signal, driving of the discharging element HT corresponding to the short is suppressed or restricted. In other words, to suppress driving of the discharging element HT corresponding to the short, the switch SW_D corresponding to the discharging element HT is put in the inactive state (made to not drive the discharging element HT). At that time, to make up for not driving the discharging element HT, it is possible to drive another discharging element HT supplementarily. For example, in the example of FIG. 2A, in the case when the short occurred for the discharging element HT of the nozzles NZ of the nozzle array 120A on one side, it is possible to drive the discharging element HT of the corresponding nozzle NZ of the nozzle array 120B on the other side in place of that discharging element HT. Also, the discharge controller 300 can notify the user of the liquid discharge apparatus 1 that the short occurred.

Also, the detector 400 can detect the foregoing short not only in the inspection mode but also in the discharging mode. In such a case, the discharge controller 300 is able to stop operation itself in the discharging mode, and may re-generate the data for transmission to the logic circuit 310 so that after operation in the discharging mode is interrupted, driving of the discharging element HT corresponding to the short is suppressed.

The discharging element HT, the driving switch SW_D, and the control switch SW_X need only be connected in series with the power supply wiring VH and the power supply wiring GNDH, and their positions may be switched. For example, the switch SW_D may be arranged on the power supply wiring GNDH side, and the switch SW_X may be arranged on the power supply wiring VH side. Also, the control switch SW_X may be arranged on the same substrate as the discharging element HT and the driving switch SW_D, but it may also be arranged on another substrate. These points are similar in all of the examples below.

Figure 4B:
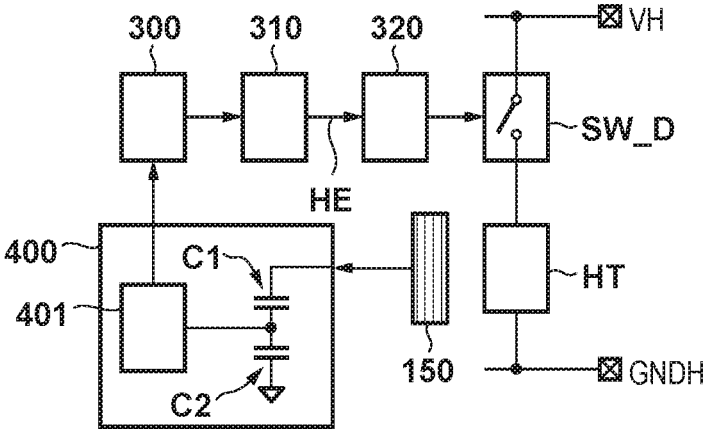

In the second example illustrated in FIG. 4B, the detector 400 includes a voltmeter 401, a first capacitive element C1 and second capacitive element C2, and outputs a control signal to the discharge controller 300 based on the result of measurement by the voltmeter 401. The capacitive element C1 includes the protection film 150 as one terminal (or a part thereof) (or one of its the terminals is directly connected to the protection film 150). The capacitive element C2 is arranged between the other terminal of the capacitive element C1 and a reference node (for example, a power supply wiring). The voltmeter 401 measures the voltage of a node between the capacitive element C1 and the capacitive element C2.

The protection film 150, as described previously, may be connected to a reference voltage (for example, 0[V]) at a relatively high impedance, but it may be in a floating state in the second example. Here, the voltage of the protection film 150 may change if a short of the protection film 150 occurred, and the voltage of the node between the capacitive element C1 and the capacitive element C2 may also change accordingly. More specifically, the voltage of the node may change based on the fluctuation amount of the voltage of the protection film 150 and a ratio between the capacitance values of the capacitive elements C1 and C2. Accordingly, the detector 400 can calculate the voltage of the protection film 150 based on the voltage of the node, and obtain the result as the electrical signal from the protection film 150. The detector 400 can detect that a short of the protection film 150 occurred by such a configuration as well. In other words, the detector 400 does not necessarily need to detect the electrical signal from the protection film 150 directly, and may detect it indirectly.

In the foregoing detection mode, if a short of the protection film 150 is detected by the detector 400, the controller $U_{C1}$, by the discharge controller 300, outputs a control signal for putting the driver $U_{D1}$ in the inactive state regardless of the image signal. By this, it is possible to suppress or prevent a current for driving the droplet discharging element HT flowing to the shorted protection film 150.

Figure 4C:
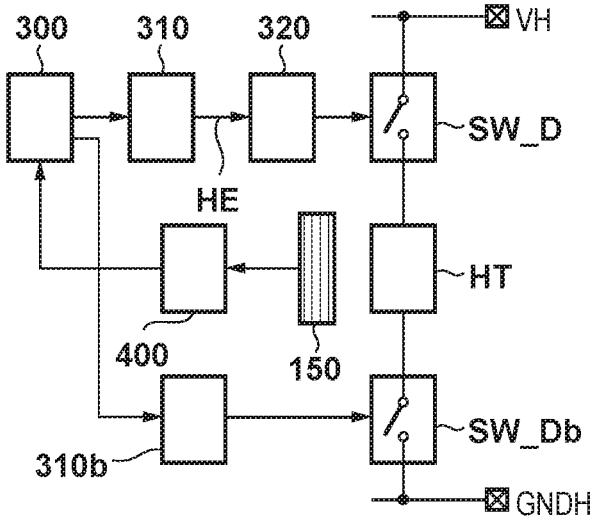

Also, in the third example illustrated in FIG. 4C, between the power supply wiring VH and the power supply wiring GNDH, in addition to the discharging element HT and the driving switch SW_D, a second driving switch SW_Db, which is connected to these in series, is arranged. Also, corresponding to the driving switch SW_Db, a second logic circuit 310*b* for processing image data from the discharge controller 300 is arranged. In the discharging mode, the driving switch SW_Db enters a conductive state/non-conductive state based on a driving signal from the logic circuit 310*b*. A level converter (not shown) may also be arranged between the logic circuit 310*b* and the driving switch SW_Db. Also, in the inspection mode, the driving switch SW_Db may be kept in the non-conductive state. By such a configuration, the detector 400 can appropriately detect that a short of the protection film 150 occurred similarly to in the first example. Accordingly, similarly to the first and second examples, the controller $U_{C1}$ can output a control signal that puts the driver $U_{D1}$ corresponding to the shorted protection film 150 in an inactive state, and thereby suppresses or prevents a current for driving the droplet discharging element HT flowing to the shorted protection film 150.

Figure 4D:
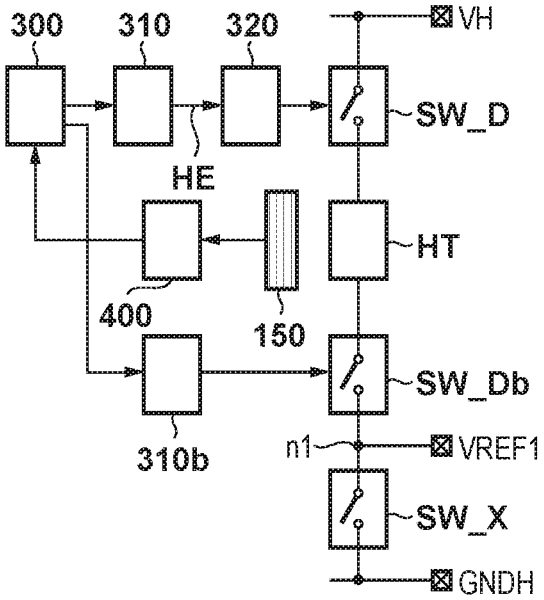

The fourth example illustrated in FIG. 4D differs from the third example (FIG. 4C) in that the control switch SW_X is further arranged. The control switch SW_X is arranged between the driving switch SW_Db and the power supply wiring GNDH, that is, the discharging element HT, and the switches SW_D, SW_Db, and SW_X are connected in series between the power supply wiring VH and the power supply wiring GNDH. Also, a node n1 between the switch SW_Db and the switch SW_X is connected to a terminal for providing a reference voltage VREF1.

In the discharging mode, the reference voltage VREF1 is not supplied to the node n1. Also, the switch SW_X is kept in the conductive state, and the switches SW_D and SW_Db enter the conductive state/non-conductive state based on the signals from the logic circuits 310 and 310*b* respectively.

Meanwhile, in the inspection mode, the reference voltage VREF1 is supplied to the node n1, and the switches SW_D and SW_X are kept in the non-conductive state, and the switch SW_Db is kept in the conductive state. The detector 400, in this state, detects a leakage current (or an amount of change therein) that flows between the protection film 150 and the reference voltage VREF1. By such a configuration, it is possible to determine whether or not a short of the protection film 150 occurred similarly to in the previously described first example.

Figure 4E:
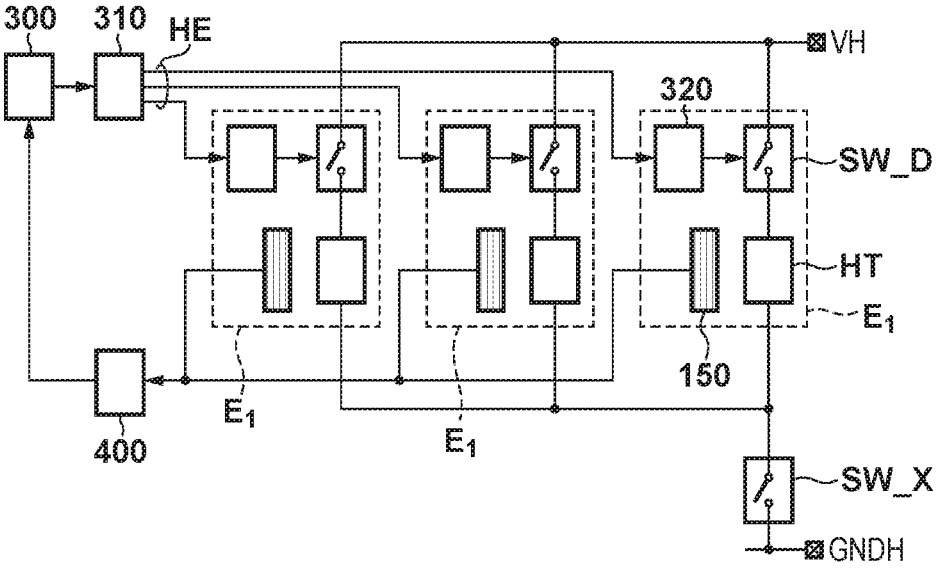

In a fifth example illustrated FIG. 4E, a plurality of elements $E_1$ are arranged where the discharging element HT, the driving switch SW_D, the protection film 150, and, the level converter 320 are made to collectively comprise an "element $E_1$" (one element $E_1$ corresponds to one nozzle NZ). Note that for simplification, three elements $E_1$ are shown graphically in FIG. 4E, but limitation is not made to this number. Other than that, FIG. 4E is similar to the first example (FIG. 4A).

According to the fifth example, the detector 400 is connected to the protection film 150 of each of the plurality of elements $E_1$, and thereby, the controller $U_{C1}$ can detect that a short occurred in one of the plurality of protection films 150. The controller $U_{C1}$ can determine that a short occurred in one of the plurality of protection films 150 from the output of the detector 400. By such a configuration, the controller $U_{C1}$ can output a control signal that puts the driver $U_{D1}$ corresponding to the shorted protection film 150 in an inactive state, and thereby suppress or prevent a current for driving the droplet discharging element HT flowing to the shorted protection film 150.

Note that in the fifth example, one protection film 150 corresponds to one discharging element HT, in other words, as illustrated in FIG. 2B, the plurality of protection films 150 that respectively correspond to the plurality of discharging elements HT are separated from each other. However, in the other example, one protection film 150 may be arranged so as to correspond to a plurality of discharging elements HT (in other words, the protection film 150 may be disposed in a single body so as to protect all of the plurality of discharging elements HT), and the same effect can be achieved is such a case.

The foregoing examples may be combined with each other so long as the spirit of the invention is not deviated from, in other words, a part of the configuration of one example may be applied in the configuration of another example. The same is true for other embodiments and examples below.

Second Embodiment

Figure 5:
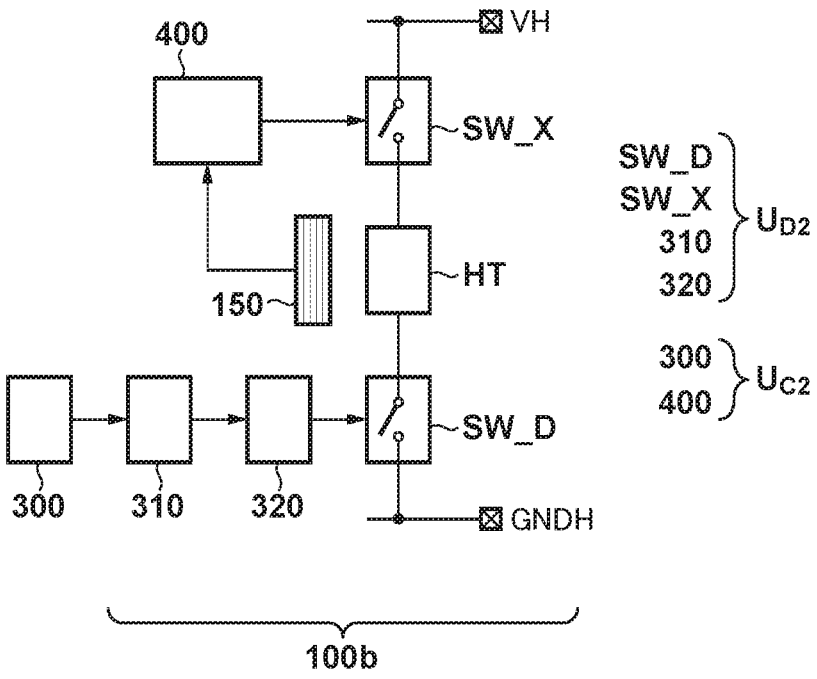
FIG. 5 is a block diagram for describing an example of a configuration of a liquid discharge head substrate.

FIG. 5 is a block diagram for describing a liquid discharge head substrate 100*b* according to the second embodiment. The second embodiment mainly differs from the previously described first embodiment in that one detector 400 corresponds to one protection film 150. In other words, if a short of the protection film 150 occurred, in the first embodiment, the discharge controller 300 (for example, an ASIC) is notified that the short occurred, and by the discharge controller 300, driving of the discharging element HT corresponding to the short is suppressed. In contrast to this, in the second embodiment, in response to a short of the protection film 150 occurring, a switch connected in series to the discharging element HT corresponding to the short is directly controlled.

In the present embodiment, the controller (made to be the controller $U_{C2}$) corresponds to the discharge controller 300 and the detector 400, and the driver (made to be the driver $U_{D2}$) corresponds to the switches SW_D and SW_X, the logic circuit 310, and the level converter 320. In the present embodiment, the detection mode and the discharging mode do not need to be set individually (for example, configuration may be such that only the discharging mode is set). In the present embodiment, in the controller $U_{C2}$, the detector 400 also handles a portion of the functions of the discharge controller 300 in the first embodiment (specifically, the function of restricting the discharge operation if a short of the protection film 150 occurred). Thus, according to a second embodiment, the discharge controller 300 controls the driving switch SW_D based on the image signal, while the control switch SW_X is controlled by the detector 400. Accordingly, in the discharging mode, it is possible to put the driving of the discharging element HT corresponding to the short into the inactive state regardless of the signal HE which is the image signal. Also, according to a second embodiment, it is possible to perform the foregoing control in less time than in the first embodiment.

Also, in the second embodiment, if a plurality of discharging elements HT are arranged so that one detector 400 corresponds to one protection film 150, a plurality of detectors 400 are arranged for a corresponding plurality of protection films 150. For this reason, according to the second embodiment, it is possible to appropriately specify which of the plurality of protection films 150 a short occurred in, and therefore driving of the discharging element HT corresponding to the protection film 150 in which the short occurred is suppressed appropriately.

Figure 6B:
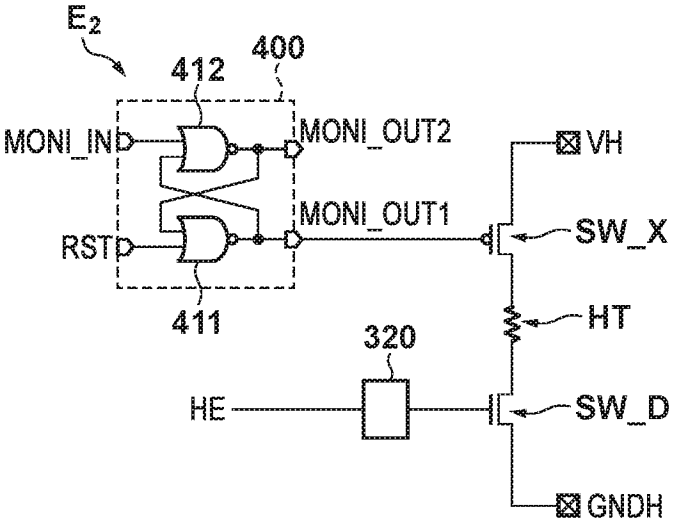
FIGS. 6A-6C are drawings for describing an example of a configuration of the liquid discharge head substrate and an example of a drive method.
Figure 6A:
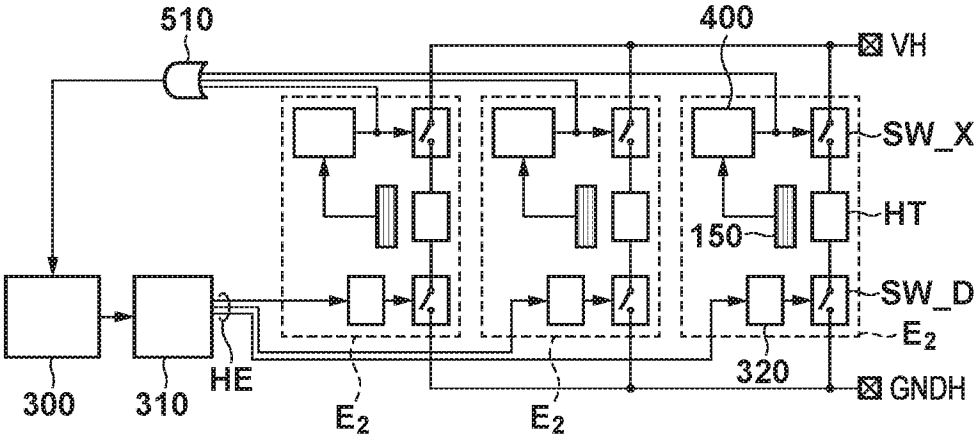

In the sixth example illustrated in FIG. 6A, a plurality (three in the drawing) of elements $E_2$ are arranged, and each element $E_2$ includes a discharging element HT, a driving switch SW_D, a control switch SW_X, a protection film 150, a level converter 320, and a detector 400. The detector 400 receives an electrical signal from the protection film 150, and supplies a signal corresponding to it to the control terminal of the control switch SW_X. In other words, one of the plurality of detectors 400 corresponding to the plurality of elements $E_2$, in a case in which a short of the corresponding protection film 150 is detected, puts the corresponding control switch SW_X in a non-conductive state in response thereto. Accordingly, driving of the discharging element HT corresponding to the protection film 150 in which the short occurred is suppressed appropriately. Note that the element $E_2$ may be of a configuration that does not have the level converter 320.

Also, in the sixth example, the substrate 100*b* comprises an OR circuit 510, and the OR circuit 510 receives output signals from a plurality of detectors 400, and outputs signals in accordance with those to the discharge controller 300. In other words, if a short of the protection film 150 is detected in any of the plurality of the detector 400, that is notified, by the OR circuit 510, to the discharge controller 300, similarly to in the first embodiment. Also, it is possible to use an encoder in place of the OR circuit 510, or accompanying the OR circuit 510, and to transmit to the discharge controller 300 information indicating which of the plurality of detectors 400 the short of the protection film 150 was detected in.

FIG. 6B illustrates a specific configuration example of the element $E_2$ in the sixth example. The discharging element HT is illustrated as a resistance element in the drawing. In this example, an NMOS transistor is used for the driving switch SW_D and a PMOS transistor is used for the control switch SW_X. Also, an RS flip flop which is configured by NOR circuits 411 and 412 is used for the detector 400. A reset signal RST is inputted into one input terminal of the NOR circuit 411 and the other input terminal is connected to an output terminal of the NOR circuit 412. A signal MONI_IN, which is an electrical signal from the protection film 150, is inputted into one input terminal of the NOR circuit 412 and the other input terminal is connected to an output terminal of the NOR circuit 411. The NOR circuits 411 and 412 respectively output logic level signals according to the signal RST and the signal MONI_IN as the output signals MONI_OUT1 and MONI_OUT2.

In the sixth example, the output signal MONI_OUT1 is supplied to the gate of a PMOS transistor which is the control switch SW_X in each element $E_2$, and also inputted into the OR circuit 510. Note that in the sixth example, the output signal MONI_OUT2 may be used.

Figure 6C:
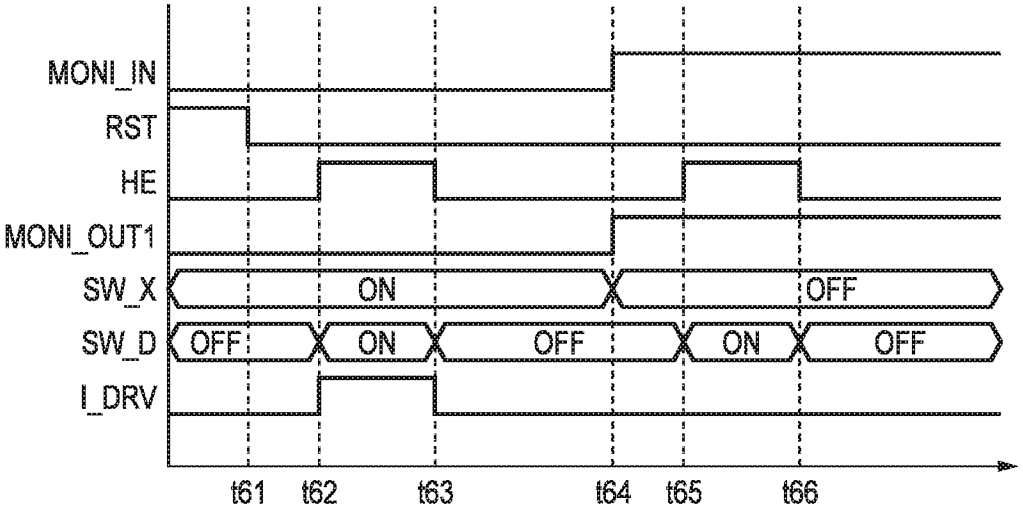

FIG. 6C is a timing chart for describing a method for controlling the substrate 100*b* in a case when a short of the protection film 150 occurred during the discharging mode. The abscissa in the drawing is made to be the time axis, and the ordinate indicates the signal levels of the signals MONI_IN, RST, HE, and MONI_OUT1, the states of the switches SW_X and SW_D, and the current amount of the driving current I_DRV that flows to the resistance element in the discharging element HT. In the drawing, for the switches SW_X and SW_D, the conductive state is indicated by "ON", and the non-conductive state is indicated by "OFF". Also, for the driving current I_DRV, a state in which a current flows to the discharging element HT is indicated by a high level (H-level) and a state in which the current is not substantially flowing to the discharging element HT is indicated by a low level (L-level). In other words, the H-level of the driving current I_DRV indicates that the discharging element HT is driven and the L-level of the driving current I_DRV indicates that the discharging element HT is not driven.

At the time t61, the signal RST is changed to the L-level from the H-level, and by this, a reset of the RS flip flop, which is the detector 400, completes. At that time, a short of the protection film 150 does not occur, and the protection film 150, as described in the first embodiment, can be connected to a reference voltage (here 0[V]) at a comparatively high impedance, and so the signal MONI_IN is the L-level. Accordingly, the signal MONI_OUT1 is the L-level, and the signal MONI_OUT2 is the H-level. Also, because the signal MONI_OUT1 is the L-level, the PMOS transistor which is the control switch SW_X is in the conductive state.

The time at which the signal HE changes from the L-level to the H-level is the time t62. At the time t62, the signal HE becomes the H-level, and the NMOS transistor which is the driving switch SW_D enters the conductive state, and so the resistance element which is the discharging element HT is energized and thereby a driving current I_DRV flows, in other words, the discharging element HT is driven.

The time at which the signal HE changes from the H-level to the L-level is the time t63. By the signal HE becoming the L-level at the time t63, the driving switch SW_D enters the non-conductive state, and so the driving current I_DRV substantially does not flow.

A time at which a short of the protection film 150 occurs after that is the time t64. The protection film 150 typically can short with the discharging element HT, and the power source voltage VH may be supplied to the protection film 150 via the control switch SW_X which is in the conductive state and the discharging element HT when the short occurs. As a result, the voltage of the protection film 150 increases, in other words, a signal MONI_IN changes from the L-level to the H-level. In accordance with the signal MONI_IN becoming the H-level, the signal MONI_OUT1 becomes the H-level, and accordingly the control switch SW_X enters a non-conductive state. In other words, at the time t64, a short of the protection film 150 occurs, and as a result of that being detected by the detector 400, the control switch SW_X enters the non-conductive state.

The time at which the signal HE once again changes from the L-level to the H-level is the time t65. The driving switch SW_D enters the conductive state by the signal HE becoming the H-level at the time t65, but since the control switch SW_X is in the non-conductive state, the driving current I_DRV does not flow. At the time t66 after that, the signal HE once again becomes the L-level, and the driving switch SW_D enters the non-conductive state.

Third Embodiment

Figure 7:
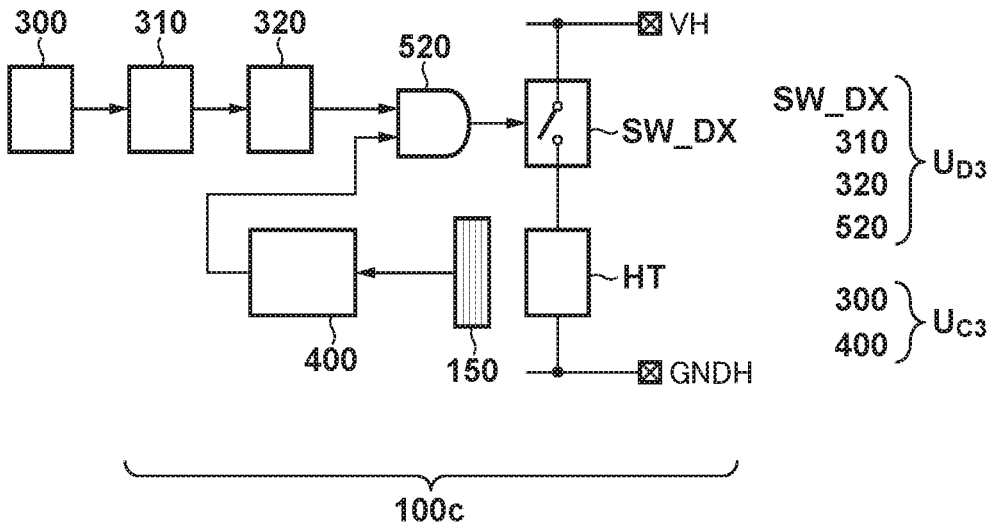
FIG. 7 is a block diagram for describing an example of a configuration of the liquid discharge head substrate.

FIG. 7 is a block diagram for describing a liquid discharge head substrate 100*c* according to the third embodiment. The third embodiment mainly differs from the previously described second embodiment in that it is configured to realize the function of the driving switch SW_D and the function of the control switch SW_X by a single switch SW_DX. The switch SW_DX is connected in series with the discharging element HT between the power supply wiring VH and the power supply wiring GNDH, and is driven by a logical product of the signal HE whose level is converted by the level converter 320 and the signal from the detector 400. Specifically, the substrate 100*c* comprises an AND circuit 520, and the AND circuit 520 supplies a logic level according to the signal HE and the signal from the detector 400 to the switch SW_DX.

In the present embodiment, the controller (made to be controller $U_{C3}$) corresponds to the discharge controller 300 and the detector 400, and the driver (made to be driver $U_{D3}$) corresponds to the switch SW_DX, the logic circuit 310, the level converter 320, and the AND circuit 520. A similar effect to the second embodiment can be obtained by such a configuration.

Figure 8B:
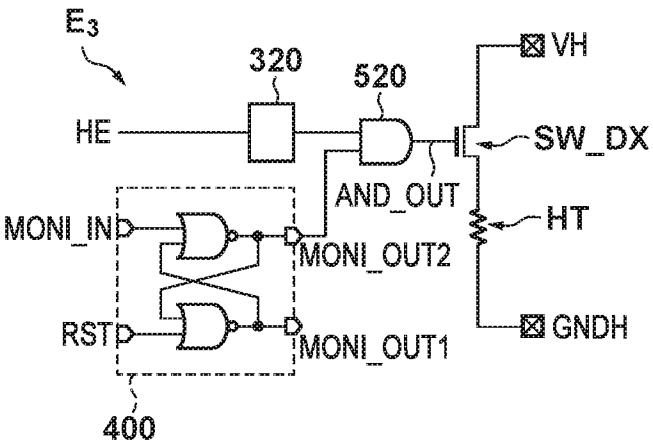
FIGS. 8A-8C are drawings for describing an example of a configuration of the liquid discharge head substrate and an example of the drive method.
Figure 8A:
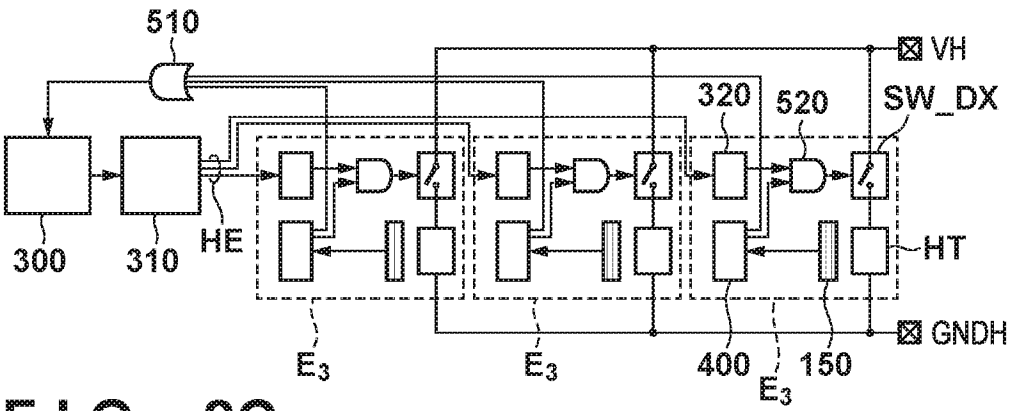
Figure 8C:
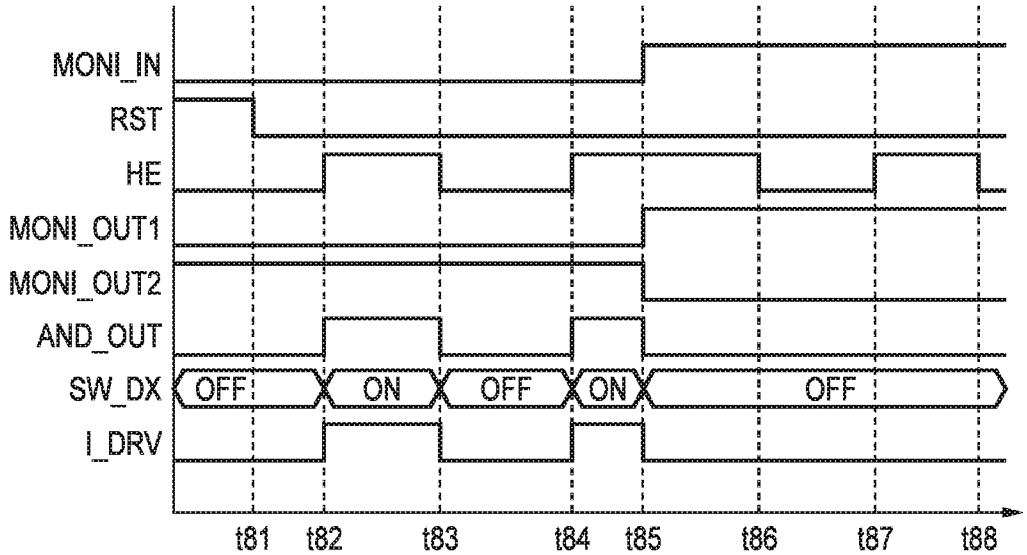

FIGS. 8A to 8C illustrate a seventh example similarly to FIGS. 6A to 6C (sixth example). The seventh example, as illustrated in FIG. 8A, is approximately the same other than the configuration of the elements $E_3$ and the configuration of the elements $E_2$ of FIG. 6A being different. FIG. 8B illustrates a specific configuration example of the element $E_3$ in the seventh example. For the switch SW_DX, an NMOS transistor (for example, an N-channel DMOS transistor) is used. For the detector 400, similarly to the sixth example, an RS flip flop is used (refer to FIG. 6B). Into the AND circuit 520, the signal HE whose level is converted by the level converter 320 and the output signal MONI_OUT2 of the detector 400 are inputted. Note that the output signal MONI_ OUT1 is inputted into the OR circuit 510, similarly to the sixth example.

FIG. 8C is a timing chart for describing a method for controlling the substrate 100*c* in a case when a short of the protection film 150 occurred during the discharging mode. On the ordinate, the signal levels of the signals MONI_IN, RST, HE, MONI_OUT1, and MONI_OUT2, the signal level of the output signal AND_OUT of the AND circuit 520, the state of the switch SW_DX, and the current amount of the driving current I_DRV are respectively indicated.

At the time t81, the signal RST is changed from the H-level to the L-level, and by this, the reset of the RS flip flop which is the detector 400 completes. At that time, the signal MONI_OUT1 is the L-level, and the signal MONI_ OUT2 is the H-level. This is as described in the description for the time t61 in the sixth example (refer to FIG. 6C). Also, at the time t81, the signal MONI_OUT2 is the H-level, but since the signal HE is the L-level, the output signal AND_ OUT of the AND circuit 520 is at the L-level, and therefore the NMOS transistor which is the switch SW_DX is in the non-conductive state.

The time at which the signal HE changes from the L-level to the H-level is the time t82. At the time t82, the signal HE becomes the H-level, and the signal AND_OUT becomes the H-level. Accordingly, the switch SW_DX enters the conductive state, and the driving current I_DRV flows.

The time at which the signal HE changes from the H-level to the L-level is the time t83. At the time t83, in accordance with the signal HE becoming the L-level, the signal AND_ OUT1 becomes the L-level, in other words, the driving switch SW_DX enters the non-conductive state. Accordingly, the driving current I_DRV does not flow.

The time at which the signal HE once again changes from the L-level to the H-level is the time t84. At the time t84, similarly to the time t82, the driving current I_DRV flows.

A time at which a short of the protection film 150 occurs after that is the time t85. As a result of the short occurring, the voltage of the protection film 150 increases, in other words, the signal MONI_IN changes from the L-level to the H-level. In accordance with the signal MONI_IN becoming the H-level, the signal MONI_OUT2 becomes the L-level, and in response to that, the signal AND_OUT becomes the L-level. Accordingly, a control switch SW_DX enters the non-conductive state. In other words, at the time t85, a short of the protection film 150 occurs, and as a result of that being detected by the detector 400, the control switch SW_DX enters the non-conductive state.

Until the time t86 thereafter, the signal HE is the H-level, and the driving current I_DRV does not flow because the control switch SW_DX is in the non-conductive state.

The time at which the signal HE once again changes from the L-level to the H-level is the time t87. Because the signal MONI_OUT2 is fixed at the L-level at the time t87, even though the signal HE became the H-level, the switch SW_DX remains in the non-conductive state. Accordingly, the driving current I_DRV does not flow. At the time t88 thereafter, the signal HE once again becomes the L-level, but description is omitted because substantially no change occurs in the respective signals.

Figure 9A:
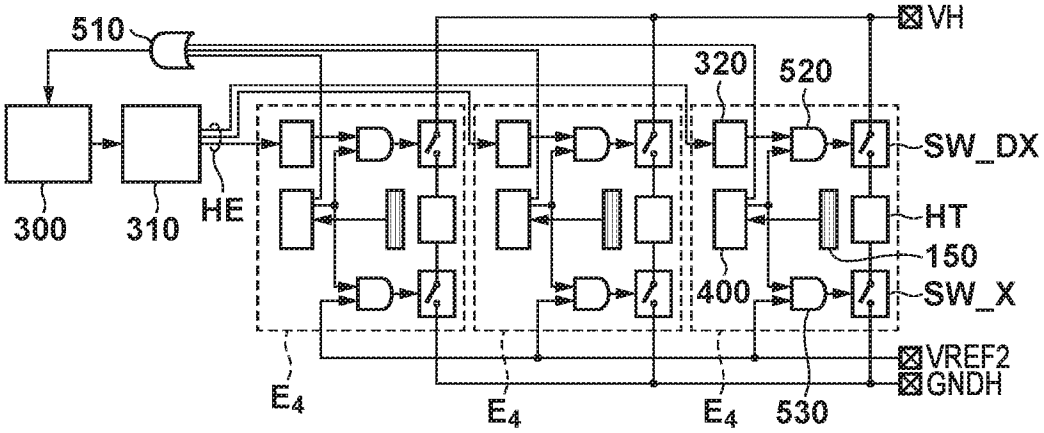
FIGS. 9A-9C are drawings for describing an example of a configuration of the liquid discharge head substrate and an example of the drive method.
Figure 9C:
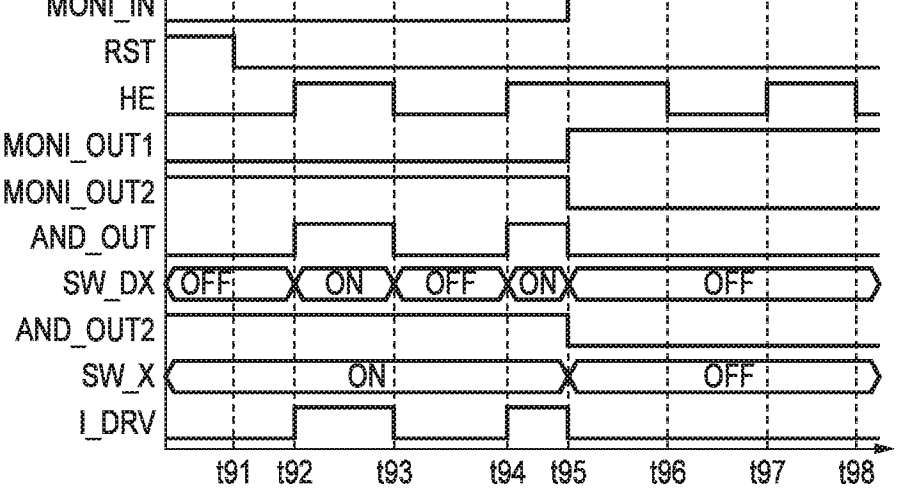
Figure 9B:
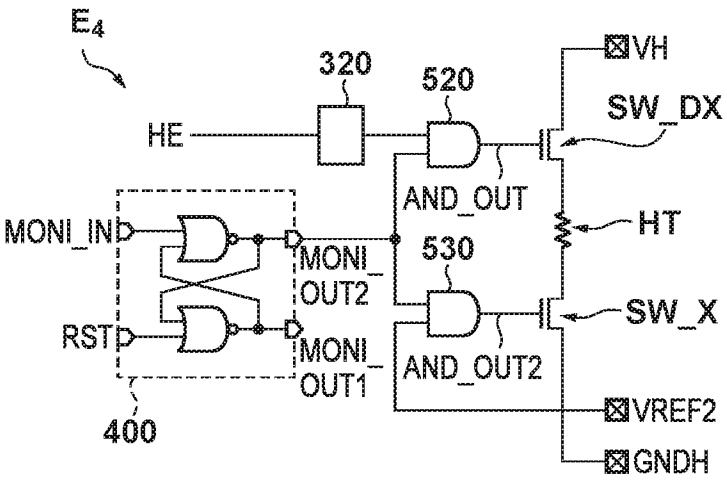

FIGS. 9A to 9C illustrate an eighth example similarly to FIGS. 8A to 8C (seventh example). In the eighth example, elements $E_4$ mainly add a control switch SW_X and an AND circuit 530 for controlling it to the elements $E_3$ of the seventh example. Specifically, in the eighth example, as illustrated in FIGS. 9A and 9B, the control switch SW_X is arranged in series with the discharging element HT and the switch SW_DX between the power supply wiring VH and the power supply wiring GNDH. The control switch SW_X is controlled from the AND circuit 530 based on a logical product of the signal MONI_OUT2 from the detector 400 and a reference signal VREF2.

For example, in the discharging mode, the reference signal VREF2 can be fixed at the H-level (in other words, so long as the signal from the detector 400 is the H-level, the control switch SW_X can be kept in the conductive state). In contrast to this, in the inspection mode, the reference signal VREF2 can be fixed at the L-level (in other words, the control switch SW_X can be kept in the non-conductive state).

Note that, in the eighth example, as illustrated in FIG. 9B, an NMOS transistor is used for the control switch SW_X, but in other examples, a PMOS transistor may be used for the control switch SW_X, and in place of the AND circuit 530, a NAND circuit may be used. A similar function is realized in such cases.

FIG. 9C is a timing chart for describing a method for controlling the substrate 100*c* in a case when a short of the protection film 150 occurred during the discharging mode.

On the ordinate, in addition to the signals (MONI_IN and the like) illustrated in FIG. 8C, the signal level of the output signal AND_OUT2 of the AND circuit 530 and the state of the switch SW_X are also indicated. The times t91 to t98 in the drawing respectively correspond to the times t81 to t88 of the seventh example (refer to FIG. 8C), and because a similar operation to the seventh example is performed in each element E, only differences from the seventh example are described below.

At the times t91 to t95, the signal MONI_IN is at the L-level and the signal MONI_OUT2 is at the H-level because no short of the protection film 150 has occurred. Also, in the discharging mode, the reference signal VREF2 is fixed to the H-level. Accordingly, the output signal AND_OUT2 of the AND circuit 530 is the H-level, and the control switch SW_X is kept in the conductive state. Accordingly, at the times t91 to t95, the switch SW_DX enters the conductive state/non-conductive state in accordance with the signal level of the signal HE (in other words, the driving current I_DRV flows when the signal HE is at the H-level, and the driving current I_DRV does not flow when the signal HE is at the L-level).

At the time t95 at which the short of the protection film 150 occurs, because the signal MONI_IN changes from the L-level to the H-level, the signal MONI_OUT2 changes from the H-level to the L-level, and thereby the signal AND_OUT2 changes from the H-level to the L-level. Accordingly, from the time t95, the control switch SW_X is fixed to the non-conductive state, and therefore regardless of the signal level of the signal HE, the driving current I_DRV does not flow.

Fourth Embodiment

In Japanese Patent Laid-Open No. 2012-101557, a liquid discharge head substrate comprising a discharging element for discharging liquid and a protection film (anti-cavitation film) for protecting the discharging element from a shock due to cavitation in a liquid is disclosed. According to Japanese Patent Laid-Open No. 2012-101557, a scorch on the protection film is removed by applying a voltage to the protection film. In the description below, removing a scorch is referred to as "scorch removal".

There are cases in which the result of cavitation in liquid is that the protection film is shorted with the discharging element or a part of its peripheral circuit (signal line, power supply wiring, or the like for driving a discharging element) due to the insulating film breaking or the like. Here, when a voltage is applied to a protection film in order to remove a scorch, there is a possibility that, in a case when the short destination of the protection film is a component having a potential such as a power supply wiring or the like, it is not possible to apply a desired voltage, and scorch removal cannot be realized appropriately.

Also, current flows to a 0[V] potential when the foregoing short occurs in a state in which a scorch is not removed (a state in which 0[V] is applied to the protection film). Therefore, in the case of a current detection method illustrated in the foregoing first example (refer to FIG. 4A), the current flows to the monitor unit 400 and the precision of detection of the short described above decreases. Also, in the case of a voltage detection method illustrated in the previously described second example (refer to FIG. 4B), a low-voltage for which the short impedance between the protection film and the short destination and the impedance from the protection film to 0[V] is divided is detected by the monitor unit 400. Therefore, the precision of detection of the foregoing short decreases in such a case as well.

In the present embodiment and the subsequent fifth and sixth embodiments, forms in which it is possible to perform protection film scorch removal, and that are advantageous at preventing the occurrence of an operation defect accompanying the occurrence a protection film short are illustrated.

Figure 10:
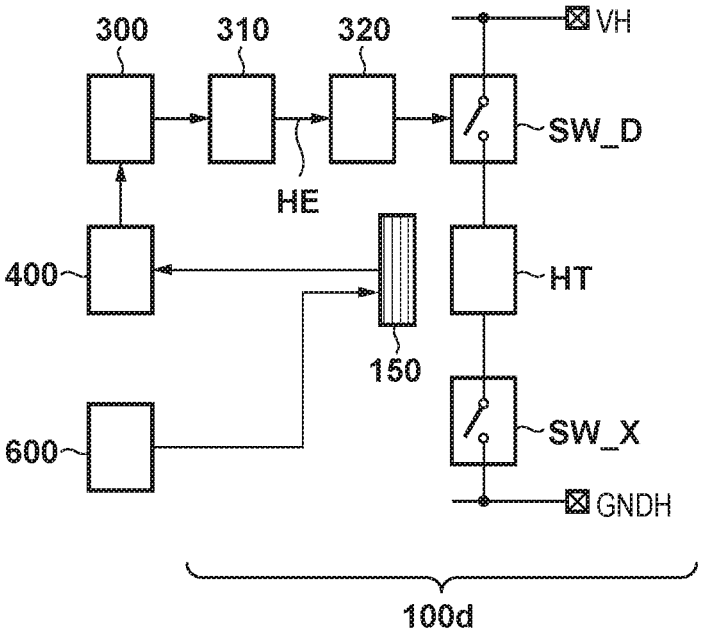
FIG. 10 is a block diagram for describing an example of a configuration of a liquid discharge head substrate.

FIG. 10 is a block diagram for describing a liquid discharge head substrate 100*d* according to the present embodiment. The present embodiment mainly differs from the previously described first embodiment in that a protection film voltage application unit 600 and a control switch SW_X are disposed.

The discharging element HT and the driving switch SW_D and control switch SW_X are connected in series between power supply wiring that transmits a power source voltage VH (24 to 32[V]) and power supply wiring that transmits a voltage GNDH (0[V]) for ground.

The protection film 150 is connected to the protection film voltage application unit 600 via the wiring pattern 132 described with reference to FIG. 2B to FIG. 2C. The protection film voltage application unit 600, when protection film scorch removal is performed, outputs a voltage (about 1 to 5[V]) to apply that voltage to the protection film 150. When not performing scorch removal, the protection film voltage application unit 600 is in an open state, in other words a state in which it is electrically separated from the protection film 150, and the protection film 150 may be connected to 0[V] via liquid in the liquid channel 161. Note that the connection between the protection film voltage application unit 600 and the protection film 150 may be realized by the protection film 150 being arranged to extend to the protection film voltage application unit 600.

Note that the protection film voltage application unit 600 may be arranged on another substrate different from the substrate 100*d*, but it may be arranged on the substrate 100*d*.

Hereinafter, using FIG. 11A to FIG. 11E, description is given with reference to several concrete examples and variations as embodiments.

Figure 11A:
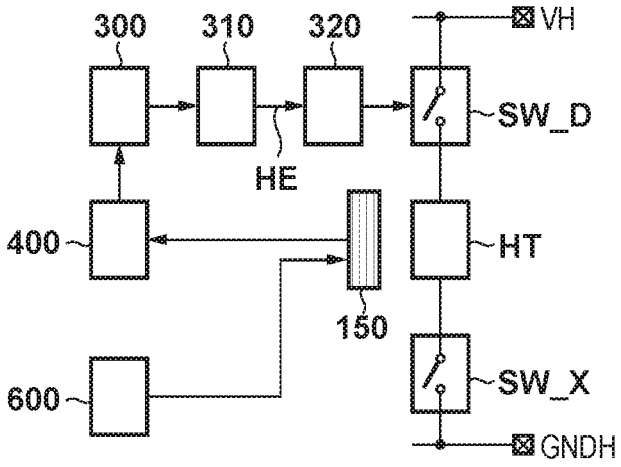
FIGS. 11A-11E are block diagrams for describing an example of a configuration of the liquid discharge head substrate.

The ninth example illustrated in FIG. 11A mainly differs from the previously described first example (refer to FIG. 4A) in that the protection film voltage application unit 600 is disposed. In the ninth example, for example, the controller 300, in addition to the discharging mode and the inspection mode, includes a scorch removal mode for removing scorches on the protection film 150 as an operation mode. In the scorch removal mode, the control switch SW_X and the driving switch SW_D are both kept in the non-conductive state. The protection film voltage application unit 600 outputs a voltage (about 1 to 5[V]) to apply it to the protection film 150 to remove a scorch. An influence on the inspection mode, such as the current value when a short of the protection film 150 occurs decreasing, is suppressed or reduced by making the output open for the protection film voltage application unit 600 in the operation modes other than the scorch removal mode (the discharging mode and the inspection mode here).

Figure 11B:
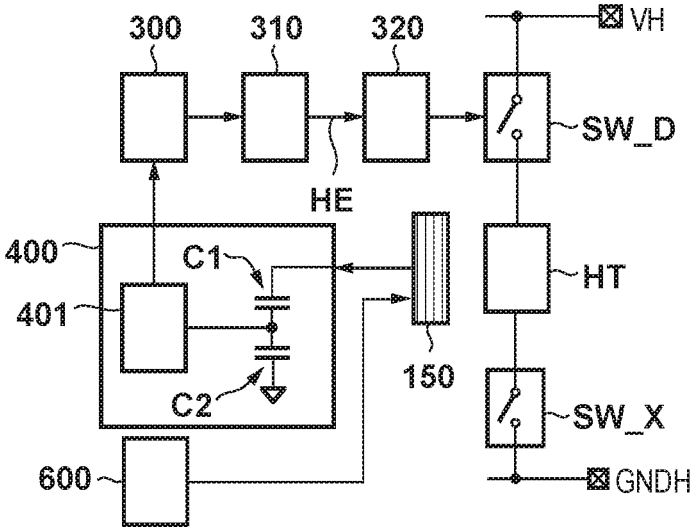

A tenth example illustrated in FIG. 11B mainly differs from the previously described second example (refer to FIG. 4B) in that the protection film voltage application unit 600 and the control switch SW_X are disposed. In the scorch removal mode, the control switch SW_X and the driving switch SW_D are both kept in a non-conductive state. The protection film voltage application unit 600 outputs a voltage (about 1 to 5[V]) to apply it to the protection film 150 to remove a scorch. In operation modes other than the scorch removal mode, the control switch SW_X is kept in a conductive state. Thus, an influence on the inspection mode, such as the voltage that is measured from the capacitive elements C1 and C2 when a short of the protection film 150 occurs decreasing, is suppressed or reduced by making the output open for the protection film voltage application unit 600.

Figure 11C:
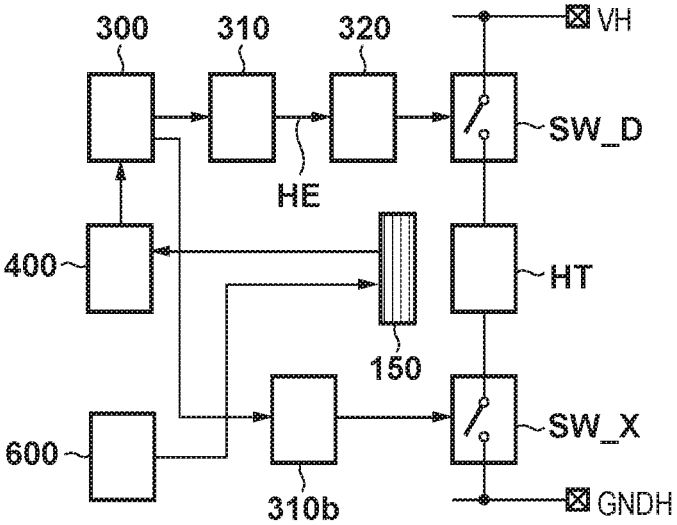

An eleventh example illustrated in FIG. 11C mainly differs from the previously described third example (refer to FIG. 4C) in that the protection film voltage application unit 600 is disposed and the driving switch SW_Db is changed to the control switch SW_X. In the eleventh example, between the power supply wiring VH and the power supply wiring GNDH, in addition to the discharging element HT and the driving switch SW_D, a control switch SW_X, which is connected to these in series, is arranged. Also, corresponding to the control switch SW_X, a second logic circuit 310*b* for processing image data from the discharge controller 300 is arranged.

In the discharging mode, the control switch SW_X enters a conductive state/non-conductive state based on a driving signal from the logic circuit 310*b*. A level converter (not shown) may also be arranged between the logic circuit 310*b* and the control switch SW_X. Also, in the inspection mode, the control switch SW_X may be kept in the non-conductive state. By such a configuration, the monitor unit 400 can appropriately detect that a short of the protection film 150 occurred similarly to in the ninth example.

Meanwhile, in the scorch removal mode, the control switch SW_X and the driving switch SW_D are both kept in a non-conductive state. The protection film voltage application unit 600 outputs a voltage (about 1 to 5[V]) to apply it to the protection film 150 to remove a scorch. An influence on the inspection mode, such as the current value when a short of the protection film 150 occurs decreasing, is suppressed or reduced by making the output open for the protection film voltage application unit 600 in the operation modes other than the scorch removal mode.

Figure 11D:
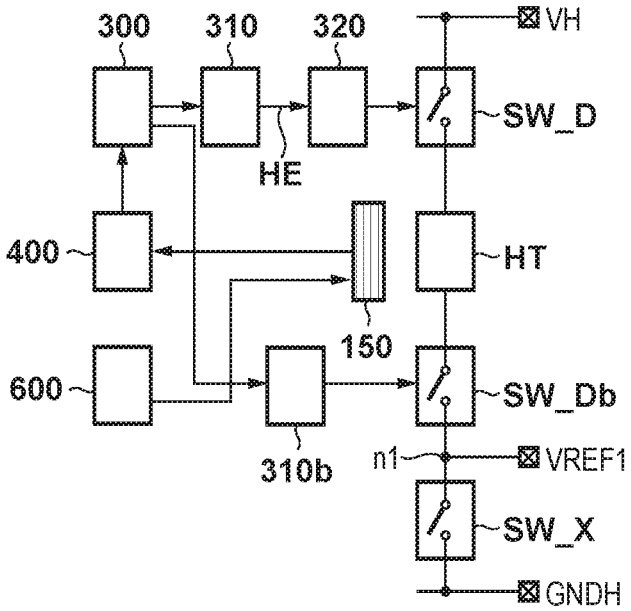

The twelfth example illustrated in FIG. 11D mainly differs from the previously described fourth example (refer to FIG. 4D) in that the protection film voltage application unit 600 is disposed. In the scorch removal mode, the driving switch SW_D and the control switch SW_Db are both kept in a non-conductive state. Also, by putting the driving switch SW_D in a non-conductive state, and not supplying the reference voltage VREF1 to the node n1, the driving switch SW_Db is put in a conductive state, and the control switch SW_X is put into a non-conductive state. The protection film voltage application unit 600 outputs a voltage (about 1 to 5[V]) to apply it to the protection film 150 to remove a scorch. An influence on the inspection mode, such as the current value when a short of the protection film 150 occurs decreasing, is suppressed or reduced by making the output open for the protection film voltage application unit 600 in the operation modes other than the scorch removal mode.

Figure 11E:
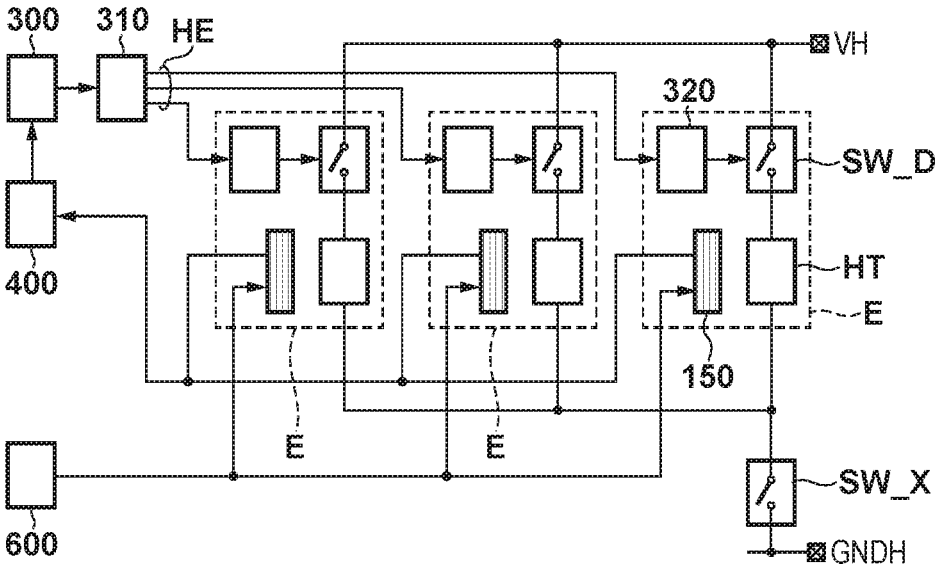

The thirteenth example illustrated in FIG. 11E mainly differs from the previously described fifth example (refer to FIG. 4E) in that the protection film voltage application unit 600 is disposed. In the scorch removal mode, the control switch SW_X and the driving switch SW_D are both kept in a non-conductive state. The protection film voltage application unit 600 outputs a voltage (about 1 to 5[V]) to apply it to the protection film 150 to remove a scorch. An influence on the inspection mode, such as the current value when a short of the protection film 150 occurs decreasing, is suppressed or reduced by making the output open for the protection film voltage application unit 600 in the operation modes other than the scorch removal mode.

The foregoing examples may be combined with each other so long as the spirit of the invention is not deviated from, in other words, a part of the configuration of one example may be applied in the configuration of another example. The same is true for other embodiments and examples below.

Fifth Embodiment

Figure 12:
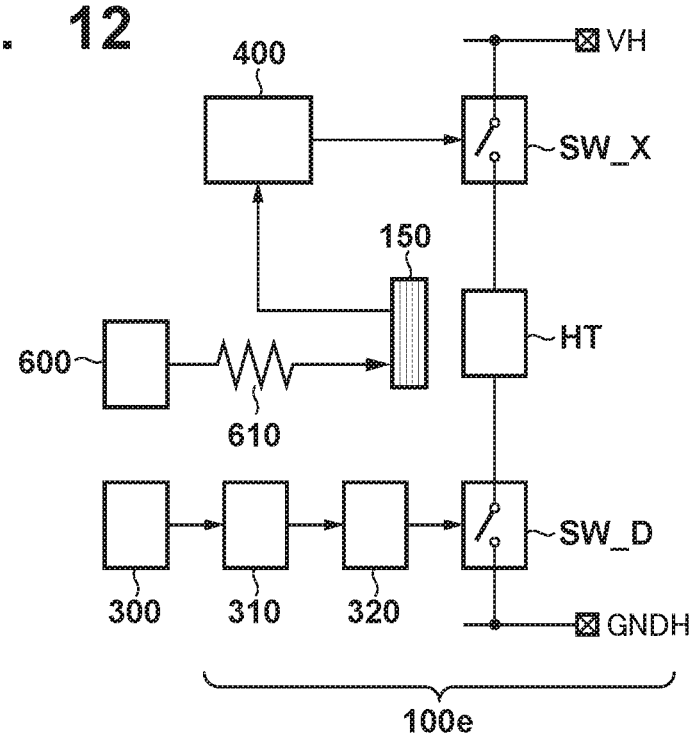
FIG. 12 is a block diagram for describing an example of a configuration of the liquid discharge head substrate.

The fifth embodiment illustrated in FIG. 12 mainly differs from the previously described second embodiment in that the protection film voltage application unit 600 and a resistor 610 are disposed. The protection film voltage application unit 600 is connected to the protection film 150 via the resistor 610. An impedance (resistance value) of the resistor 610 is set to be several [KΩ], for example, and is set to a value that is larger than a short impedance between the protection film 150 and the short destination.

In the present embodiment, in the scorch removal mode, the protection film voltage application unit 600 outputs a voltage (about 1 to 5[V]) to apply it to the protection film 150 to remove a scorch. Meanwhile, in the operation modes other than the scorch removal mode, the protection film voltage application unit 600 outputs 0[V]. By virtue of the present embodiment, the impedance of the resistor 610 is set to be larger than the foregoing short impedance. For that reason it is possible to prevent a decrease in detection voltage according to the monitor unit 400, and thereby the influence on the monitor unit 400 is suppressed or reduced.

The resistor 610 may be realized by elongation or narrowing of the wiring of the wiring 132 (refer to FIG. 2B to FIG. 2C) connected between the protection film 150 and the protection film potential application unit 600. As other examples, the resistor 610 may be realized by elongating or narrowing a part of the protection film 150, and another resistor such as a high-resistance wiring layer or a diffusion resistance may be added between the protection film 150 and the protection film potential application unit 600.

Figure 13:
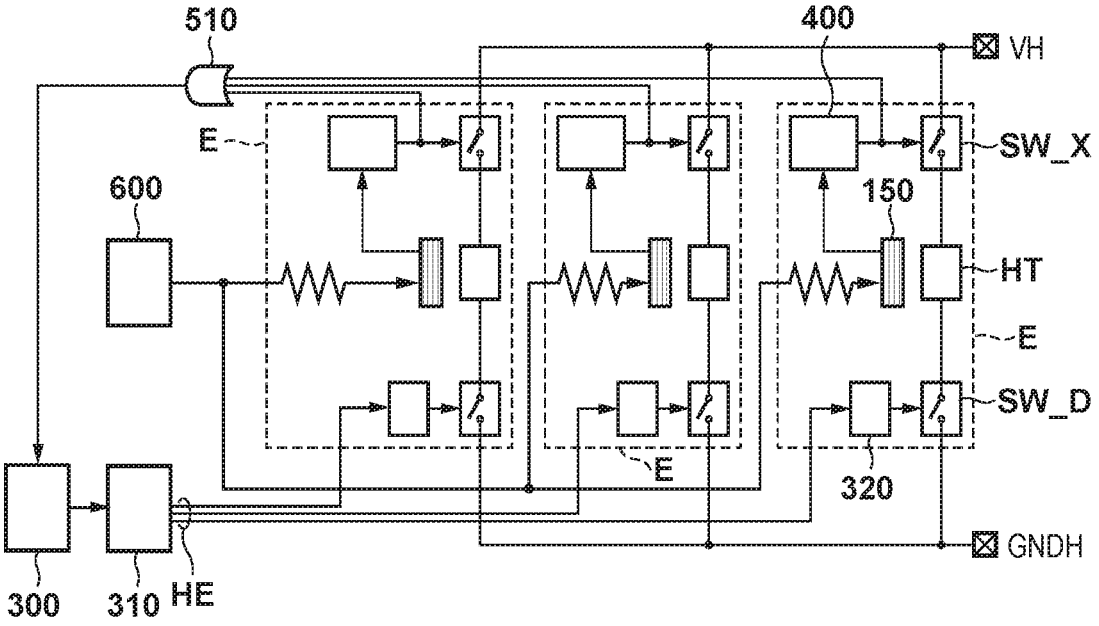
FIG. 13 is a block diagram for describing an example of a configuration of the liquid discharge head substrate.

The fourteenth example illustrated in FIG. 13 mainly differs from the previously described sixth example (refer to FIGS. 6A-6C) in that the protection film voltage application unit 600 and the resistor 610 are disposed. In the fourteenth example, a plurality (three in the drawing) of elements E are arranged, and each element E includes the discharging element HT, the driving switch SW_D, the control switch SW_X, the protection film 150, the monitor unit 400, and the resistor 610. The protection film voltage application unit 600 is connected to each element E via the resistor 610.

In the scorch removal mode, the protection film voltage application unit 600 outputs a voltage (about 1 to 5[V]) to apply it to the protection film 150 to remove a scorch. Meanwhile, in the operation modes other than the scorch removal mode, the protection film voltage application unit 600 outputs 0[V]. The impedance of the resistor 610 is sufficiently larger than the foregoing short impedance. For this reason, even if a short occurs in the protection film 150, the voltage of the shorted portion is not reduced by much, the voltage of the protection film 150 is inputted into the monitor unit 400, and thereby, the influence on the monitor unit 400 is suppressed or reduced. Note that even if a part of the protection film 150 is shorted, 0[V] is applied to other parts that are not shorted, and therefore a misdetection in the monitor unit 400 related to other non-shorted parts is prevented.

Sixth Embodiment

Figure 14:
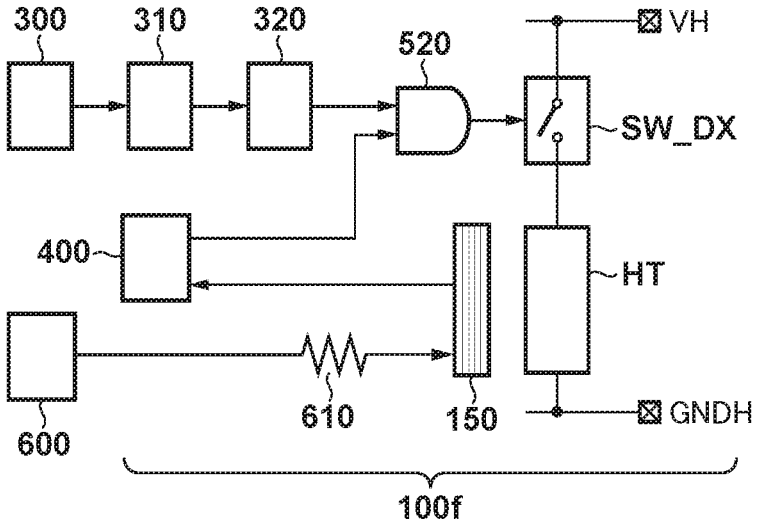
FIG. 14 is a block diagram for describing an example of a configuration of the liquid discharge head substrate.

The sixth embodiment illustrated in FIG. 14 mainly differs from the previously described third embodiment in that the protection film voltage application unit 600 and the resistor 610 are disposed. The protection film voltage application unit 600 is connected to the protection film 150 via the resistor 610. The impedance of the resistor 610, similarly to in the foregoing fifth embodiment, is set to be a value (for example, several [KΩ]) larger than the short impedance between the protection film 150 and the short destination.

In the scorch removal mode, the protection film voltage application unit 600 outputs a voltage (about 1 to 5[V]) to apply it to the protection film 150 to remove a scorch. In the operation modes other than the scorch removal mode, the protection film voltage application unit 600 outputs 0[V]. By virtue of the present embodiment, the impedance of the resistor 610 is set to be larger than the foregoing short impedance. For that reason, it is possible to prevent a decrease in detection voltage according to the monitor unit 400, and thereby the influence on the monitor unit 400 is suppressed or reduced.

The resistor 610 may be realized by elongation or narrowing of the wiring of the wiring 132 connected between the protection film 150 and the protection film potential application unit 600. Also, it may be realized by elongating or narrowing a part of the protection film 150, and another resistor such as a high-resistance wiring layer or a diffusion resistance may be added between the protection film 150 and the protection film potential application unit 600.

Figure 15:
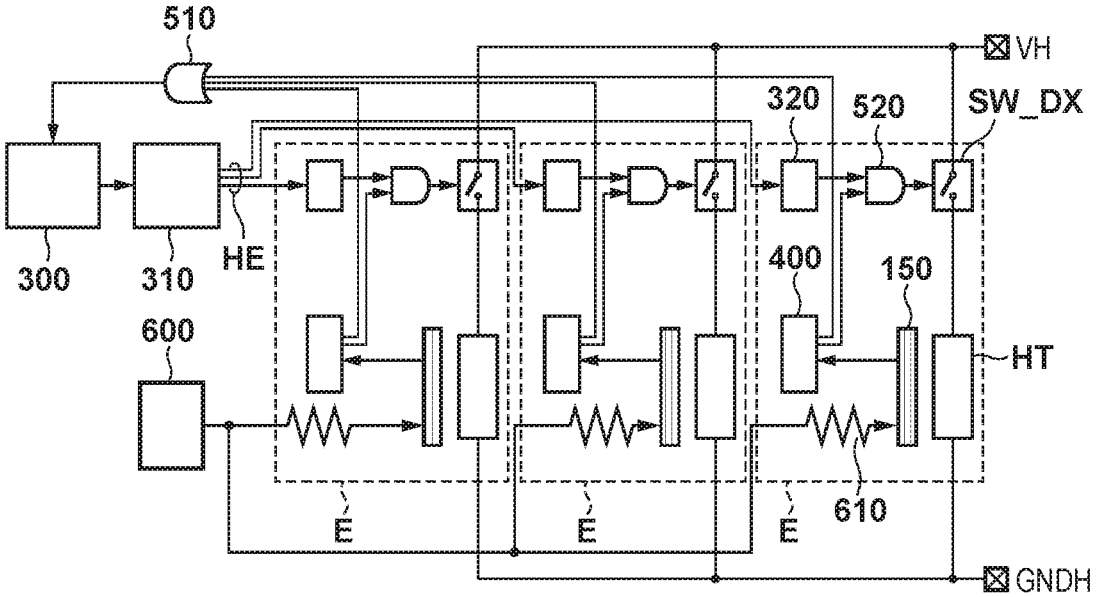
FIG. 15 is a block diagram for describing an example of a configuration of the liquid discharge head substrate.

The fifteenth example illustrated in FIG. 15 mainly differs from the previously described seventh example (refer to FIGS. 8A-8C) in that the protection film voltage application unit 600 and the resistor 610 are disposed. In the fifteenth example, the protection film voltage application unit 600 is connected to the protection film 150 via the resistor 610 of each element E.

In the scorch removal mode, the protection film voltage application unit 600 outputs a voltage (about 1 to 5[V]) to apply it to the protection film 150 to remove a scorch. In the operation modes other than the scorch removal mode, the protection film voltage application unit 600 outputs 0[V]. The impedance of the resistor 610 is sufficiently larger than the foregoing short impedance. For this reason, even if a short occurs in the protection film 150, the voltage of the shorted portion is not reduced by much, the voltage of the protection film 150 is inputted into the monitor unit 400, and thereby, the influence on the monitor unit 400 is suppressed or reduced. Note that even if a part of the protection film 150 is shorted, 0[V] is applied to other parts that are not shorted, and therefore a misdetection in the monitor unit 400 related to other non-shorted parts is prevented.

Figure 16:
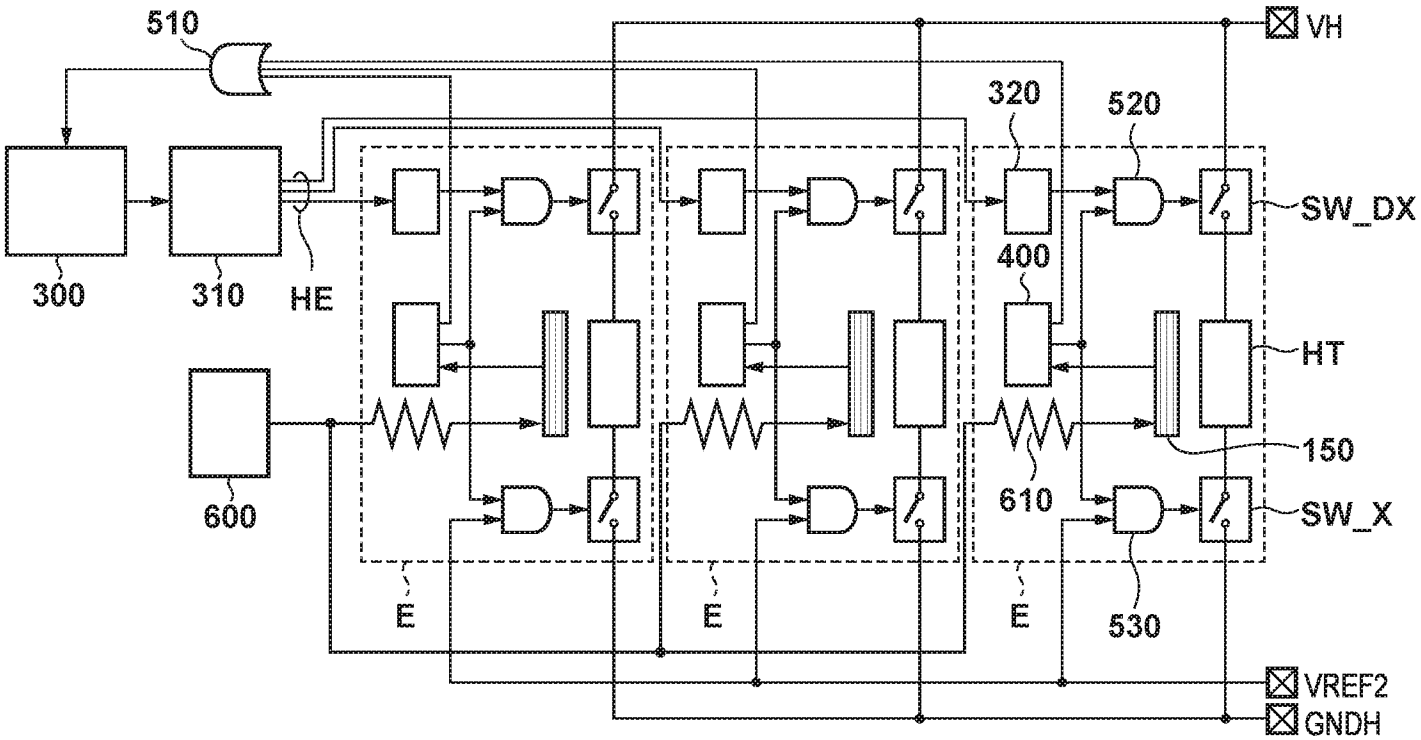
FIG. 16 is a block diagram for describing an example of a configuration of the liquid discharge head substrate.

The sixteenth example illustrated in FIG. 16 mainly differs from the previously described seventh example (refer to FIG. 8) in that it comprises the protection film voltage application unit 600 and the resistor 610. In the sixteenth example, the protection film voltage application unit 600 is connected to the protection film 150 via the resistor 610 of each element E.

In the scorch removal mode, the protection film voltage application unit 600 outputs a voltage (about 1 to 5[V]) to apply it to the protection film 150 to remove a scorch. In the operation modes other than the scorch removal mode, the protection film voltage application unit 600 outputs 0[V]. The impedance of the resistor 610 is sufficiently large compared to the foregoing short impedance. For this reason, even if a short occurs in the protection film 150, the voltage of the shorted portion is not reduced by much, the voltage of the protection film 150 is inputted into the monitor unit 400, and thereby, the influence on the monitor unit 400 is suppressed or reduced. Note that even if a part of the protection film 150 is shorted, 0[V] is applied to other parts that are not shorted, and therefore a misdetection in the monitor unit 400 related to other non-shorted parts is prevented.

(Other)

Also, while preferred embodiments of the present invention and variations thereof are described above, the present invention is not limited to these examples, and these may be modified in a scope that does not deviate from the gist of the invention. Also, the individual terms recited in the present specification are merely used with the objective of describing the present invention, and it goes without saying that the present invention is not limited to the strict meaning of these terms, but includes equivalents thereof.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2016-124799, filed on Jun. 23, 2016 and No. 2017-102959, filed on May 24, 2017, which are hereby incorporated by reference herein in their entirety.

What is claimed is:

1. A liquid discharge device comprising:

a discharging element configured to discharge a liquid;

a driver configured to drive the discharging element;

a conductive protection film covering the discharging element via an insulating film; and a controller connected to the protection film and configured to output a control signal that sets the driver in an inactive state when a change of a voltage of the protection film or a change in a current that flows to the protection film is detected.

2. The liquid discharge device according to claim 1, wherein the controller detects a current that flows between the protection film and the discharging element which are separated from each other by the insulating film, and outputs the control signal if a value of the current becomes larger than a reference value.

3. The liquid discharge device according to claim 1, wherein the controller detects a voltage of the protection film and outputs the control signal if a value of the voltage is outside of an allowable range.

4. The liquid discharge device according to claim 3, further comprising a first capacitive element including the protection film as one terminal and a second capacitive element connected between the other terminal of the first capacitive element and a reference voltage, wherein a voltage of a node between the first capacitive element and the second capacitive element follows a change of the voltage or a change of the current, and the controller outputs the control signal based on the voltage of the node.

5. The liquid discharge device according to claim 1, wherein the driver includes a switch, the discharging element and the switch are connected in series between a first power supply wiring and a second power supply wiring that transmit power supply voltages that are different from each other, and the driver enters an inactive state by the switch being fixed in a non- conductive state based on the control signal.

6. The liquid discharge device according to claim 1, wherein the driver includes a first switch and a second switch, the discharging element and the first switch and the second switch are connected in series between a first power supply wiring and a second power supply wiring that transmit power supply voltages that are different from each other, the first switch is driven based on a signal that indicates whether or not to discharge the liquid, and the driver enters an inactive state by the second switch being fixed in a non- conductive state based on the control signal.

7. The liquid discharge device according to claim 1, wherein the discharging element is arranged above a semiconductor substrate on which the driver is disposed, the liquid discharge device further comprises a wiring pattern above the semiconductor substrate that is covered by the discharging element and the insulating film and that is connected to the controller, the protection film is arranged so as to overlap at least a part of the wiring pattern and the discharging element in a plan view in relation to a top surface of the semiconductor substrate, and the protection film is connected to the at least part of the wiring pattern via a contact hole disposed in the insulating film.

8. The liquid discharge device according to claim 7, further comprising a liquid supplying member in which a liquid channel for guiding the liquid to the discharging element is arranged, and the contact hole is disposed at a position that does not overlap with the liquid channel in the insulating film in the plan view.

9. The liquid discharge device according to claim 1, wherein the discharging element is one of a plurality of discharging elements, and the protection film is arranged integrally so as to protect the plurality of discharging elements.

10. The liquid discharge device according to claim 1, wherein the discharging element is one of a plurality of discharging elements, and the protection film is one of a plurality of protection films corresponding to the plurality of discharging elements and separated from each other.

11. The liquid discharge device according to claim 10, wherein the driver is one of a plurality of drivers for respectively driving the plurality of discharging elements, and the controller outputs a control signal for setting the plurality of drivers in an inactive state based on a change of the voltage and a change of the current relating to at least one of the plurality of protection films.

12. The liquid discharge device according to claim 1, comprising a voltage application unit configured to apply a voltage to the protection film and a monitor unit, wherein the monitor unit outputs a control signal to control whether the driver is active or inactive based on an electrical signal from the protection film when the voltage from the voltage application unit is not applied to the protection film.

13. The liquid discharge device according to claim 12, wherein the driver includes a first switch and a second switch, the first switch and the discharging element are connected in series to the second switch between a first power supply wiring and a second power supply wiring that transmit power supply voltages that are different from each other, the first switch and the second switch are fixed in a non-conductive state when a voltage is applied to the protection film from the voltage application unit, and the voltage application unit is electrically separated from the protection film when the voltage is not applied.

14. The liquid discharge device according to claim 12, wherein the voltage application unit is connected to the protection film via a resistor.

15. The liquid discharge device according to claim 14, wherein the resistor is a part of wiring connecting the protection film and the voltage application unit that is elongated.

16. The liquid discharge device according to claim 14, wherein the resistor is a part at which wiring connecting the protection film and the voltage application unit is narrowed.

17. The liquid discharge device according to claim 14, wherein the resistor is a high-resistance wiring connecting the protection film and the voltage application unit.

18. The liquid discharge device according to claim 14, wherein the resistor is a diffusion resistance.

19. A liquid discharge head comprising a liquid device, the liquid discharge device comprising:

a discharging element configured to discharge a liquid;

a driver configured to drive the discharging element;

a conductive protection film covering the discharging element via an insulating film; and a controller connected to the protection film and configured to output a control signal that sets the driver in an inactive state when a change of a voltage of the protection film or a change in a current that flows to the protection film is detected.

20. A liquid discharge apparatus comprising a liquid discharge head and a controller, the liquid discharge head substrate comprises:

a discharging element configured to discharge a liquid;

a driver configured to drive the discharging element; and a conductive protection film covering the discharging element via an insulating film, wherein the controller is connected to the protection film and configured to output a control signal that sets the driver in an inactive state when a change of a voltage of the protection film or a change in a current that flows to the protection film is detected.

21. A liquid discharge device, comprising;

a logic circuit; and a plurality of units, said plurality of units including (i) a discharging element configured to discharge a liquid, (ii) a driver configured to drive the discharging element, and (iii) a conductive protection film covering the discharging element via an insulating film, wherein a plurality of conductive protection films corresponding to the plurality of units are separated from each other between the plurality of units, and the logic circuit has an input node electrically connected to the conductive protection film and an output node electrically connected to the driver.

22. The liquid discharge device according to claim 21, wherein the logic circuit detects a current that flows between the protection film and the discharging element which are separated from each other by the insulating film, and the logic circuit outputs a control signal that sets the driver in an inactive state if a value of the current becomes larger than a reference value.

23. The liquid discharge device according to claim 21, wherein the logic circuit detects a voltage of the protection film and outputs a control signal that sets the driver in an inactive state if a value of the voltage is outside of an allowable range.

24. The liquid discharge device according to claim 21, wherein the driver includes a switch, the discharging element and the switch are connected in series between a first power supply wiring and a second power supply wiring that transmit power supply voltages that are different from each other, and the driver enters an inactive state by the switch being fixed in a non-conductive state based on a control signal from the logic circuit.

25. The liquid discharge device according to claim 21, wherein the driver includes a first switch and a second switch, the discharging element and the first switch and the second switch are connected in series between a first power supply wiring and a second power supply wiring that transmit power supply voltages that are different from each other, the first switch is driven based on a signal that indicates whether or not to discharge the liquid, and the driver enters an inactive state by the second switch being fixed in a non- conductive state based on a control signal from the logic circuit.

26. The liquid discharge device according to claim 21, further comprising a voltage application unit configured to apply a voltage to the protection film; and a monitor unit configured to output a control signal to control whether the driver is active or inactive based on an electrical signal from the protection film when the voltage from the voltage application unit is not applied to the protection film.

27. A liquid discharge apparatus, comprising:

a logic circuit; and a liquid discharge head including a plurality of units, each of which includes (i) a discharging element configured to discharge a liquid, (ii) a driver configured to drive the discharging element, and (iii) a conductive protection film covering the discharging element via an insulating film, wherein a plurality of conductive protection films corresponding to the plurality of units are separated from each other between the plurality of units, and the logic circuit has an input node electrically connected to the conductive protection film and an output node electrically connected to the driver.

* * * * *